US006431434B1

(12) United States Patent
Haughton et al.

(10) Patent No.: US 6,431,434 B1
(45) Date of Patent: Aug. 13, 2002

(54) INDIVIDUAL BEVERAGE CARTON WITH A STRAW THEREIN AND A METHOD OF MANUFACTURE

(76) Inventors: Keith Louis Haughton, 760 Quebec Street, Midland Ontario (CA), L4R 1E8; Glenn Wallace Haughton, 75 Broadway Ave, Suite 414, Toronto Ontario (CA), M4P 1V1; Peter Christopher Michael Hillar, 4129 Jesse Thomson Road, Stouffville Ontario (CA), L4A 7X5

( * ) Notice: Subject to any disclaimer, the term of this patent is extended or adjusted under 35 U.S.C. 154(b) by 0 days.

(21) Appl. No.: 09/401,314

(22) Filed: Sep. 23, 1999

(51) Int. Cl.[7] ..... B65D 77/28

(52) U.S. Cl. ..... 229/103.1; 220/708; 220/710

(58) Field of Search ..... 229/103.1; 220/705, 220/708, 710; 215/388

(56) References Cited

U.S. PATENT DOCUMENTS

| | | | | |
|---|---|---|---|---|
| 2,800,265 A | | 7/1957 | Pugh, Sr. | |
| 2,844,267 A | | 7/1958 | Petriccione | |
| 3,074,610 A | | 1/1963 | Pugh | |
| 3,240,415 A | * | 3/1966 | Pugh, Sr. | 229/103.1 |
| 3,268,792 A | * | 8/1966 | Barmherzig | 220/710 |
| 3,303,984 A | | 2/1967 | Jurena | |
| 3,303,985 A | | 2/1967 | Prokes et al. | |
| 3,325,076 A | | 6/1967 | Soucy | |
| 3,397,830 A | | 8/1968 | Chang | |
| 3,462,061 A | | 8/1969 | Shore | |
| 3,486,679 A | | 12/1969 | Pfahler | |
| 3,542,278 A | * | 11/1970 | Deaver | 229/103.1 |
| 3,559,868 A | | 2/1971 | Chang | |
| 3,568,870 A | * | 3/1971 | Elston | 215/388 |
| 3,717,476 A | | 2/1973 | Harvey | |
| 4,126,263 A | | 11/1978 | Martensson | |
| 4,194,674 A | | 3/1980 | Pearson | |
| 4,225,556 A | | 9/1980 | Lothman et al. | |
| 4,267,957 A | | 5/1981 | Holmstrom | |
| 4,293,369 A | | 10/1981 | Dilot et al. | |
| 4,294,362 A | | 10/1981 | Martensson | |
| 4,301,927 A | | 11/1981 | Carlsson et al. | |
| 4,312,450 A | | 1/1982 | Reil | |
| 4,331,288 A | | 5/1982 | Lothman | |
| 4,343,402 A | | 8/1982 | Holmstrom | |
| 4,345,415 A | | 8/1982 | Jarund | |
| 4,367,828 A | | 1/1983 | Reil | |
| 4,387,547 A | | 6/1983 | Reil | |
| 4,391,385 A | | 7/1983 | Rausing | |
| 4,410,128 A | | 10/1983 | Rausing | |
| 4,445,309 A | | 5/1984 | Reil | |
| 4,462,202 A | | 7/1984 | Reil | |
| 4,464,156 A | | 8/1984 | Holmstrom | |
| 4,526,314 A | | 7/1985 | Reil | |
| 4,528,803 A | | 7/1985 | Ott | |
| 4,546,592 A | | 10/1985 | Reil | |
| 4,570,788 A | | 2/1986 | Lindsjo | |
| 4,604,850 A | | 8/1986 | Reil | |
| 4,606,174 A | | 8/1986 | Berg | |
| 4,617,779 A | | 10/1986 | Nygren et al. | |
| 4,718,598 A | | 1/1988 | Pupp et al. | |

(List continued on next page.)

*Primary Examiner*—Gary E. Elkins
(74) *Attorney, Agent, or Firm*—Nancy E. Hill; Hill & Schumacher

(57) ABSTRACT

A liquid container of plastic coated boxboard, laminated cardboard or the like having a straw therein is disclosed. The container includes a container body, a holder, a straw and a seal. The container has an interior volume and a plurality of exterior walls. The holder is mounted with a liquid and gas tight seal in an exterior wall. The holder has an aperture formed therein. A straw extends through the aperture in the holder with a snug fit. The straw has a stowed position and an in use position. The seal is for sealing the straw in the stowed position with a liquid and gas tight seal thereby sealing the liquid inside the container. A method of manufacturing the container with a straw therein in a continuous form, fill and sealing process is also disclosed.

23 Claims, 25 Drawing Sheets

U.S. PATENT DOCUMENTS 4,747,253 A 5/1988 Schulte
4,798,295 A 1/1989 Rausing
4,798,296 A 1/1989 Lagerstedt et al.
4,804,134 A 2/1989 Reil
4,828,138 A 5/1989 Andersson
4,848,063 A 7/1989 Niske
4,861,328 A 8/1989 Franke et al.
4,986,859 A 1/1991 Watanabe
5,000,337 A 3/1991 Im
5,067,311 A 11/1991 Andersson
5,068,005 A 11/1991 Lindskog et al.
5,101,999 A 4/1992 Robichaud et al.
5,116,105 A 5/1992 Hong
5,148,971 A 9/1992 Ahn
5,158,633 A 10/1992 Rausing
5,160,058 A * 11/1992 Ahn ..... 229/103.1
5,188,283 A 2/1993 Gu
5,482,202 A 1/1996 Wen
5,823,422 A * 10/1998 Collier et al. ..... 220/710
6,076,729 A * 6/2000 Cornell et al. ..... 229/103.1

* cited by examiner

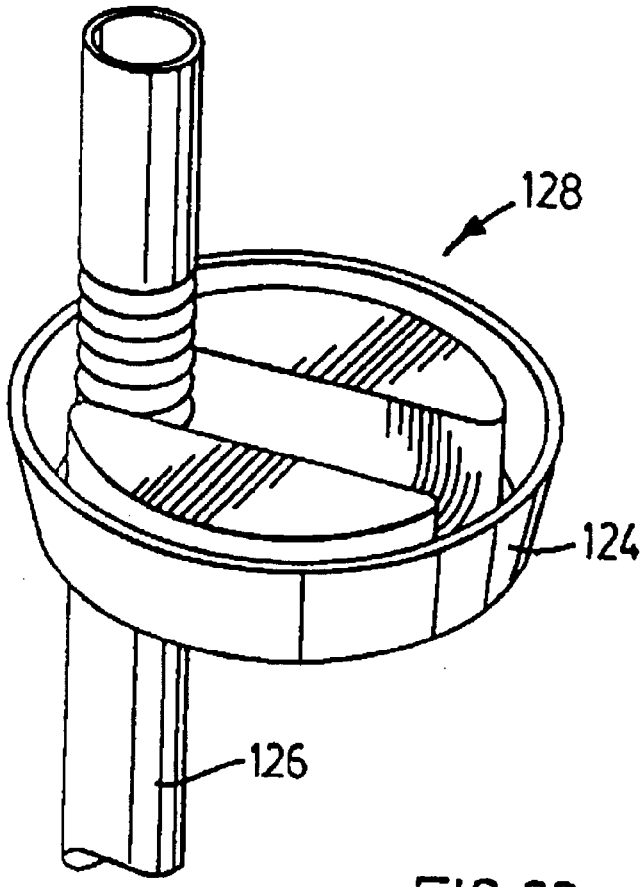
FIG.23
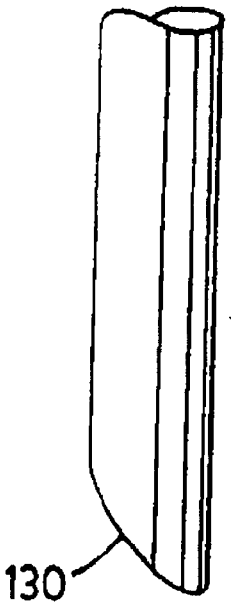

INDIVIDUAL BEVERAGE CARTON WITH A STRAW THEREIN AND A METHOD OF MANUFACTURE

CROSS REFERENCE TO RELATED PATENT APPLICATION

This patent application relates to Patent Cooperation Treaty application PCT/CA99/00400 which designates the United States and was filed May 13, 1999 and entitled STOPPERS FOR INDIVIDUAL BEVERAGE CONTAINERS.

FIELD OF THE INVENTION

The present invention relates generally to the provision of a drinking straw with an individual beverage carton and in particular to the provision of a drinking straw on the inside of an individual beverage carton and a method of manufacture thereof.

BACKGROUND OF THE INVENTION

Packaged individual beverage cartons of plastic coated paper board sheet material folded into a generally parallelepipedic shape have been made available to consumers for many years and are often referred to as "juice boxes".

Various arrangements have been proposed to provide a straw with an individual beverage carton. In general, a cylindrical plastic drinking straw is packaged in a separate sealed plastic envelope and attached usually with an adhesive to the outside of the beverage carton. The straw may be straight or it may have an accordion type bend therein. In use, the consumer is required to remove the drinking straw from its envelope and insert it through the packaging of the container at a predetermined place usually on the top of the container, the straw then being ready to allow consumption of the beverage from the container. As the drinking straw once inserted into the beverage carton makes consumption of the beverage possible, conversely consumption of the beverage from the container without the use of the drinking straw is problematic and objectionable.

One disadvantage of the assembly as described above is that the straw has to be inserted into the beverage carton prior to use. In order to insert the drinking straw into the beverage carton the consumer has to pierce a portion of the carton. Typically there is a preferred point of entry or insertion point that can be identified by a round hole in the carton (but not in the foil liner) on its top. However, the consumer has to puncture the foil liner so that the straw has access to the liquid therein. The foil liner can withstand relatively high pressures such that the carton will not readily leak at the insertion point. As the act of inserting the drinking straw through the packaging material at the predetermined place requires considerable force, the beverage carton also needs to be simultaneously held soundly. This holding soundly often means squeezing the beverage carton and therefore there exists the risk that beverage will rapidly vacate the beverage carton either up the straw or around the straw at the insertion point upon insertion, thereby causing the beverage to be spilled. The consumer is at risk of spilling the beverage on themselves or someone or something at hand. This risk is further increased by the fact that a high percentage of these beverages are consumed by children, individuals that may lack some degree of hand coordination or who may consider the spraying of liquid desirable. This, of course, is not desirable or a game to the parent.

Another disadvantage of the current system of attaching the drinking straw and protective plastic envelope to the outside of the beverage carton is that the protective plastic envelope will often merely be discarded as litter. Commonly, removal of the existing drinking straw currently provided with the beverage carton of the previously mentioned type also requires removal of the straw's protective plastic envelope from the outside of the beverage carton to which it is attached when received by the consumer. This leaves the consumer in the possession of the now empty plastic envelope and due to the small size of the plastic envelope and its low weight the consumer is often tempted to discard the plastic envelope as litter. As the empty envelope is manufactured of plastic, the envelope will exist in the environment for some time before breaking down and due to its small size and low weight is not likely to be picked up as garbage.

A still further disadvantage of the current system of attaching the drinking straw and protective plastic envelope to the outside of the beverage carton is that the straw will obscure the writing and art work on one side of the carton. In addition, as the plastic envelope containing the drinking straw is attached to the outside of the beverage carton there exists considerable risk that the plastic envelope and drinking straw will be inadvertently removed from the outside of the beverage carton and lost, placing the consumer in a compromised position when the time comes for the consumption of the beverage from the container.

Some arrangements have been proposed wherein a straw is provided in an individual beverage carton. For example U.S. Pat. No. 5,188,283 issued to Gu on Feb. 23, 1993, shows a straw in four different types of containers. In the parallelepipedic shaped container there is provided a hole in the container through which the straw is positioned. A groove is provided on the inside of the top tuck flap that is in registration with a top portion of the straw when the tuck flap is sealed to the container. Another example of providing a straw in a parallelepipedic shaped container is shown in U.S. Pat. No. 5,482,202 issued to Wen on Jan. 9, 1996. This container has a straw that is attached in the seams of the container and in at least one embodiment the straw extends from a top side edge to the opposed bottom side edge. An alternate approach is shown in U.S. Pat. No. 5,116,105 issued to Hong on May 26, 1992. This container has a short straw or pipette attached to the underside of the top tuck flap which is the extension of the top seam. The short straw is less than half the width of the container and is used more as a pouring spout than a drinking straw. The short straw is on the outside of the container and has to be inserted through the side wall of the container.

Each of these examples of a straw provided in an individual beverage container suffers from disadvantages. The Gu container would be difficult to manufacture. Firstly, the groove would be difficult to form in the top tuck flap. Secondly the top tuck flap with the groove therein would be difficult to seal once the container is filled with liquid. Thirdly the straw, hole and groove arrangement would not be adaptable to the continuous form, fill and seal process that is preferred for the manufacture of parallelepipedic shaped containers. The Wen container similarly would not be adaptable to the continuous form, fill and seal process since a good seal in a seam having a straw therein would be difficult to achieve. Further, a straw in the seam might lead to leakage through the straw. The Hong container provides a pour spout but does not eliminate the necessity of the consumer having to push the short straw or pipette into the container with all of the disadvantages associated therewith and it also has the disadvantage described above that the straw can be easily lost.

As the preferred method of manufacture of existing parallelepipedic plastic coated paper board material beverage cartons, involves a continuous form, fill and seal process, there are limited opportunities for the application of a drinking straw on the inside of the carton, so that the drinking straw may be inside the beverage carton at the time of purchase of the beverage by the consumer.

In general, the form, fill and seal process is composed of the steps of unrolling a preprinted and precreased plastic laminated paper board sheet; forming the sheet into a columnar sleeve; sealing a longitudinal seal along the columnar sleeve; adding the beverage into the sealed columnar sleeve; forming a transverse seal across the columnar sleeve and through the beverage; cutting the package from the columnar sleeve and forming a parallelepipedic carton with folded and fixed tabs.

With beverage cartons having a straw attached thereto, drinking straws that have been previously encased in their protective plastic envelopes are attached to one side of the completed beverage carton.

Accordingly it would be advantageous to provide a drinking straw on the inside of an individual beverage carton. Further it would be advantageous to provide a method of manufacturing an individual beverage carton that includes steps to provide a straw on the inside of the beverage carton.

In light of the previously mentioned limitations of existing beverage cartons of the parallelepipedic plastic coated paper board type, it is an object of the present invention to provide a beverage carton of the parallelepipedic plastic coated paper board type with a drinking straw on the inside of the beverage carton at the time of purchase and therefore also at the time of consumption of the beverage by the consumer.

It is another object of the present invention to provide a drinking straw with the beverage carton that is accessible by the consumer from the outside of the beverage carton.

A number of advantages would be realized by the provision of a straw on the inside of an individual beverage carton, namely the necessity by the consumer of having to insert the drinking straw through the packaging material is eliminated, thereby reducing the risk of accidental spillage of beverage and contamination of the drinking straw; the necessity of a protective envelope for the drinking straw is eliminated, since the drinking straw is present inside the beverage carton at the time of purchase and consumption of the beverage by the consumer; and the risk of having the drinking straw detached from the outside of the container is also eliminated. A further advantage that may be realized by the provision of a straw on the inside of an individual beverage carton is that since the drinking straw does not have to be used to pierce the packaging material, a straw of a thinner more flexible wall design may be used. Alternatively, a straw with a larger diameter and a thinner wall may be used, without increasing the amount of material used in the straw as compared to currently used straws. It is anticipated that a larger diameter straw would allow for easier consumption of the beverage.

SUMMARY OF THE INVENTION

The present invention is disclosed as being a drinking straw, a holder and a removable strip which together are attached to a paper board or plastic sheet material in such a manner that when the sheet is formed into a beverage carton the drinking straw and holder exist inside the beverage carton while the removable strip occurs on the outside of the beverage carton.

Further, the removable strip, holder and drinking straw are arranged so that the removable strip is accessible and removable by the consumer of the beverage and that upon removal of the strip, the upper portion of the drinking straw is exposed while the remainder of the straw is held in place in the beverage carton. The exposed portion of the drinking straw is then available for consumption of the beverage in the usual manner.

The drinking straw, holder and strip are manufactured as a preassembled unit, requiring only attachment of the preassembled unit to the sheet material at the time of formation, filling and sealing of the individual beverage cartons at the packaging facility.

The drinking straw has an overall length just slightly greater than the height of the formed beverage carton and is of a resiliently deformable material of hollow cylindrical shape and may or may not possess a region of corrugations to ease the resilient deformability requirement of the straw material.

The holder has a trough region to accept a portion of the drinking straw, a hole and sleeve region to support the remaining portion of the drinking straw and a flange to allow attachment of the holder to the sheet material of the beverage carton.

The removable strip is made of plastic, foil or the like and is sized to completely cover the trough region of the holder without infringing much of the flange area of the holder while possessing mechanical strength sufficient to resist accidental penetration by foreign objects into the beverage carton.

Further, the removable strip has an extended tab to facilitate removal of the strip by the consumer, that is, by pulling on the tab, the strip would be progressively stripped from the holder. It is recognized that the removable strip could include advertising or promotional material on its upper and/or lower surfaces.

Necessarily, the sheet plastic or paper board material would be cut with an oblong hole at the predetermined place that the drinking straw is to exit the beverage carton, such that attachment of the preassembled unit would occur around the perimeter of the so cut oblong hole on the "inside" side of the sheet material.

In one aspect of the present invention a liquid container of plastic coated boxboard, laminated cardboard or the like having a straw therein is disclosed. The container includes a container body, a holder, a straw and a seal. The container has an interior volume and a plurality of exterior walls. The holder is mounted with a liquid and gas tight seal in an exterior wall. The holder has an aperture formed therein. A straw extends through the aperture in the holder with a snug fit. The straw has a stowed position and an in use position. The seal is for sealing the straw in the stowed position with a liquid and gas tight seal thereby sealing the liquid inside the container.

In another aspect of the present invention a holder for use in a liquid container is disclosed. The holder includes a trough, a flange and a sleeve. The trough has an aperture formed therein dimensioned to receive a straw snugly therein. The flange extends laterally from the trough and is attachable to the carton. The sleeve extends orthogonally from the trough with the distal end thereof encircling the aperture.

In a still further aspect of the present invention a method of manufacturing the container with a straw therein in a continuous form, fill and sealing process is disclosed. The process includes the following steps: unrolling a rolled sheet material being comprised of a plurality of carton sections, each carton section having a hole formed therein; sealingly attaching the holder/straw assembly to the sheet material over said hole; attaching a strip to the holder/straw assembly; forming the sheet into a columnar sleeve; sealing a longitudinal seal along the columnar sleeve; adding the beverage into the sealed columnar sleeve; forming a top and bottom transverse seal across the columnar sleeve and through the beverage; cutting individual cartons from the columnar sleeve; and forming a parallelepipedic carton having a drinking straw therin.

Further features of the invention will be described or will become apparent in the course of the following detailed description.

BRIEF DESCRIPTION OF THE DRAWINGS

The invention will now be described by way of example only, with reference to the accompanying drawings, in which:

FIG. 23 is a perspective view of a holder of the present invention showing an alternate embodiment of an inner portion of holder having a straw integrally attached thereto;

DETAILED DESCRIPTION OF THE INVENTION

Figure 1:
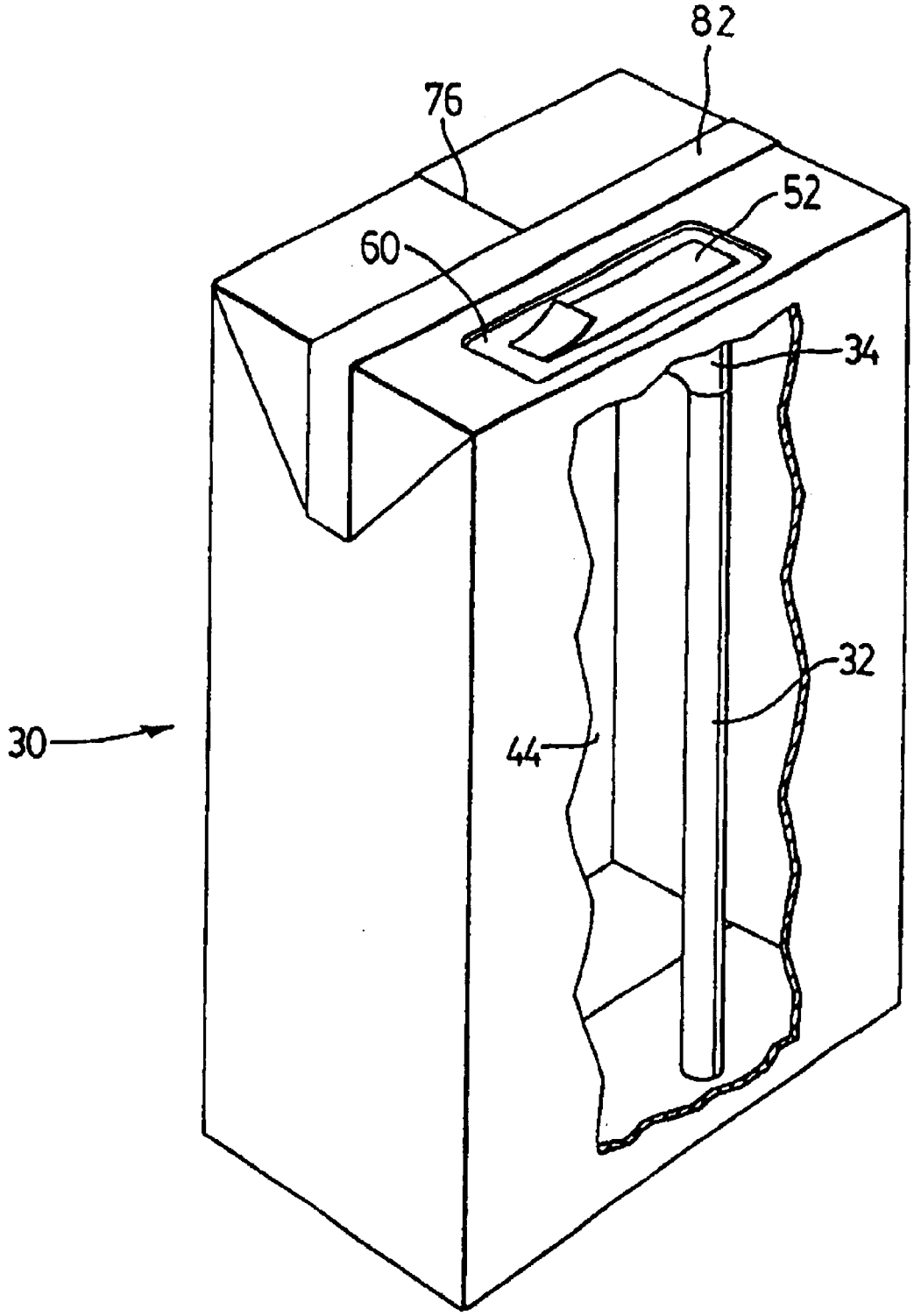
FIG. 1 is a perspective view of a carton of the present invention shown with a portion of the side panel broken away.

Referring to FIG. 1 the individual beverage carton of the present invention is shown generally at 30. The beverage carton 30 includes a straw 32, a straw holder 34 and a sealing strip 52.

Figure 2:
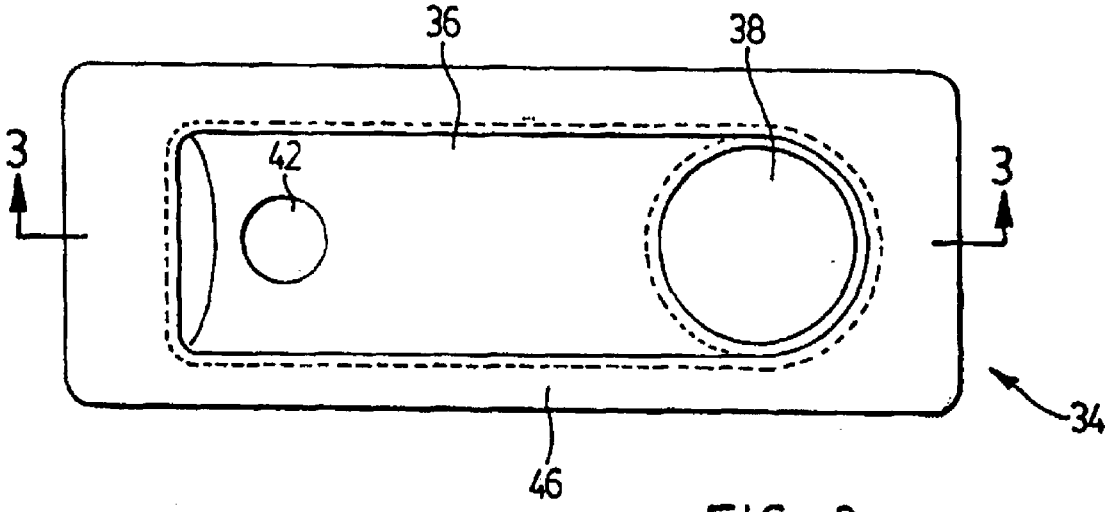
FIG. 2 is a top view of the holder of the present invention.
Figure 3:
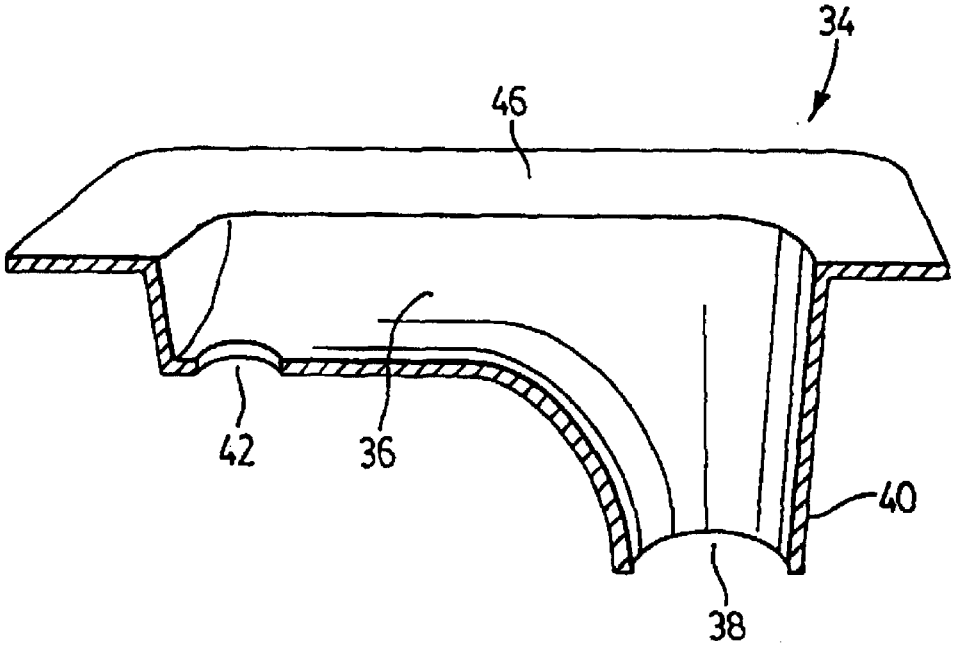
FIG. 3 is a partial perspective view of the holder, shown along the line 3—3 of FIG. 2.
Figure 4:
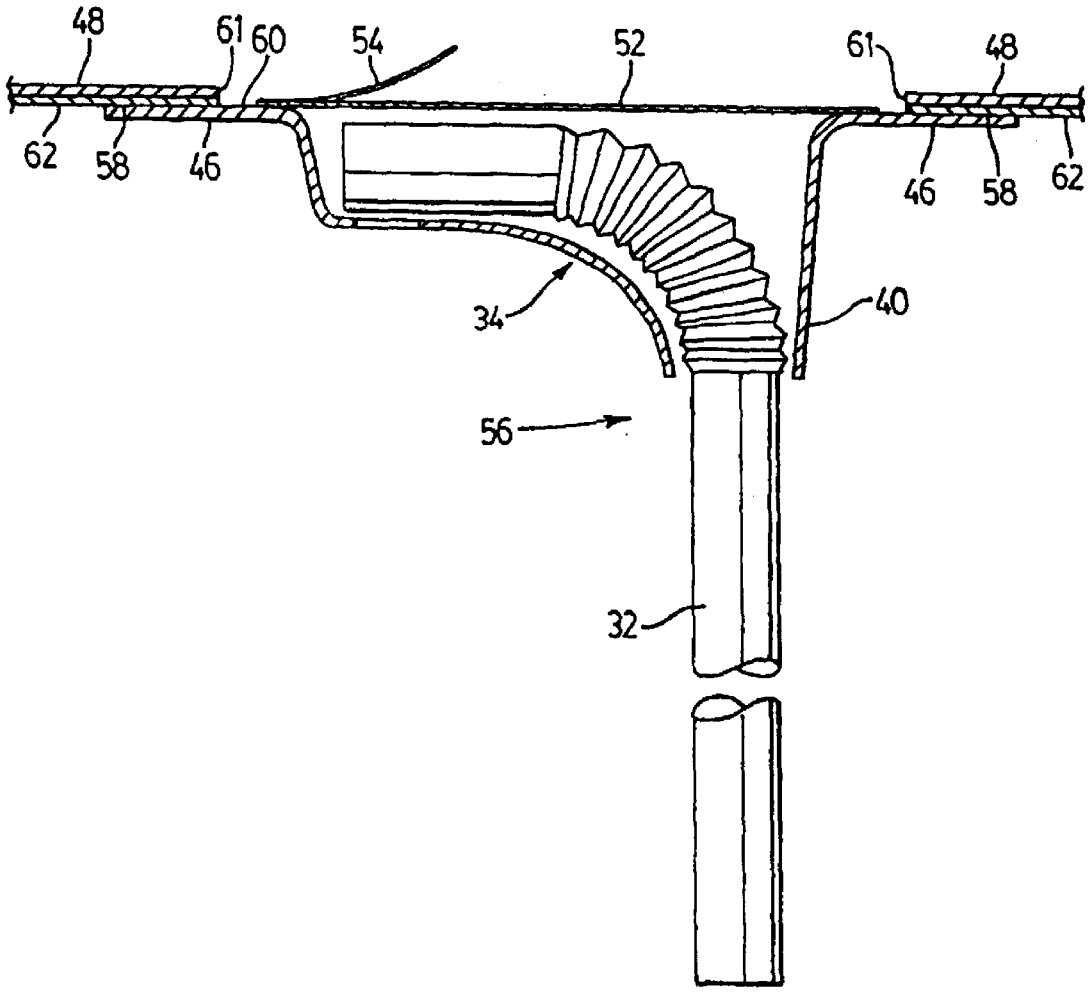
FIG. 4 is a sectional view of the assembly attached to the inner surface of the sheet material of the carton.
Figure 5:
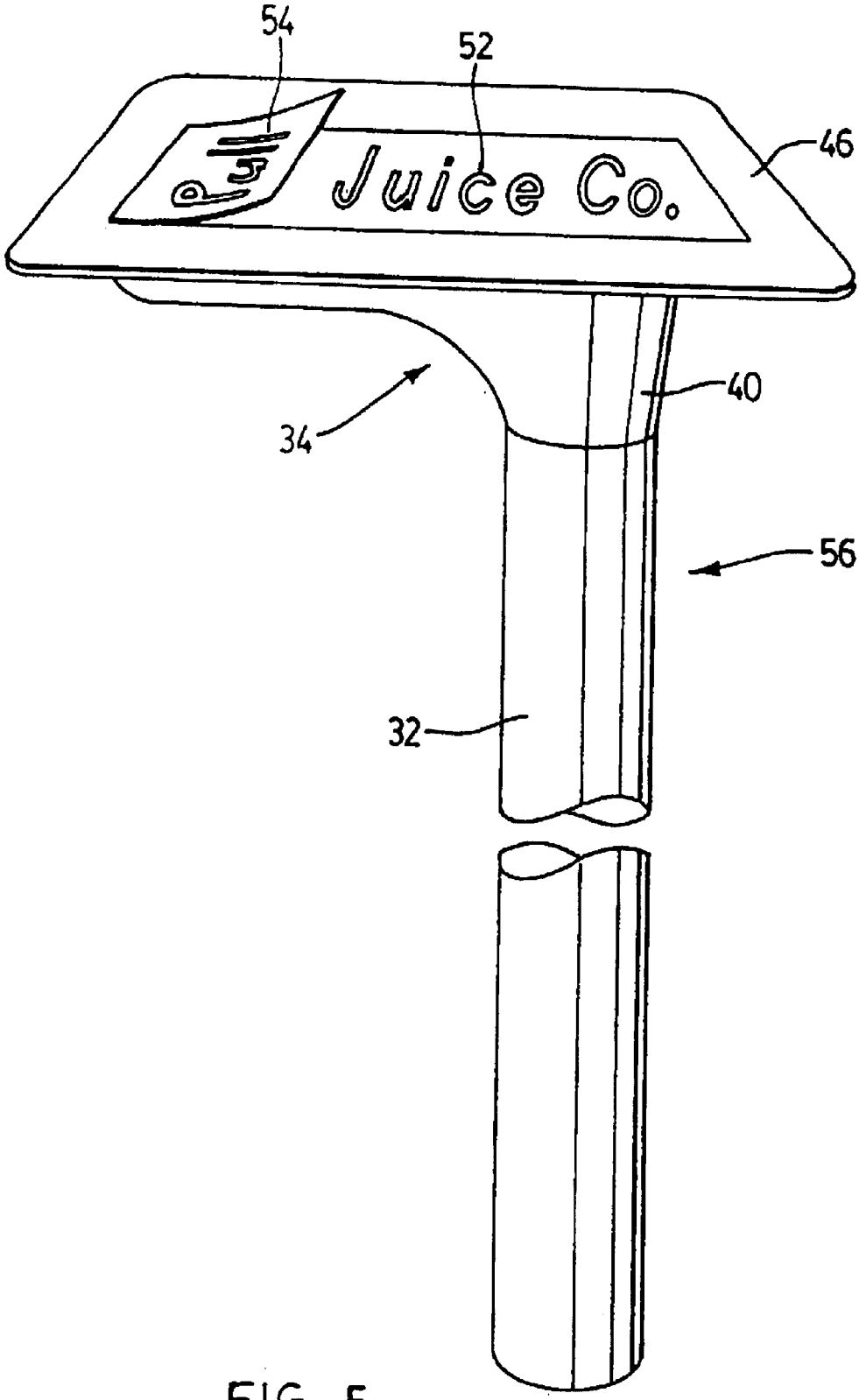
FIG. 5 is a perspective view of the holder, straw and strip assembly of the present invention.

The holder 34 for the straw 32 is shown in more detail in FIGS. 2 and 3 and with the straw 32 therein in FIGS. 4 and 5. The holder 34 has a trough 36 to accept a portion of the straw 32, an aperture 38 for the straw 32 to pass therethrough and a sleeve 40 to support the remaining portion of the straw 32. The holder 34 has a flange 46 around the perimeter of the trough 36 thereby providing a surface for attaching the holder 34 to the material 48 of the beverage carton 30.

A vent hole 42 is provided in trough 36 to allow atmospheric pressure to gain access into the beverage carton 30 to facilitate consumption of the beverage with the straw 32 by the consumer. Alternatively, the hole 42 need not be provided if there is sufficient clearance between the straw 32 and the aperture 38 of the holder 34 to allow atmospheric pressure to enter the internal volume 44 of the beverage carton 30. This allows the consumer to suck the beverage up through the straw 32 without creating a vacuum inside the beverage container 30.

Figure 7:
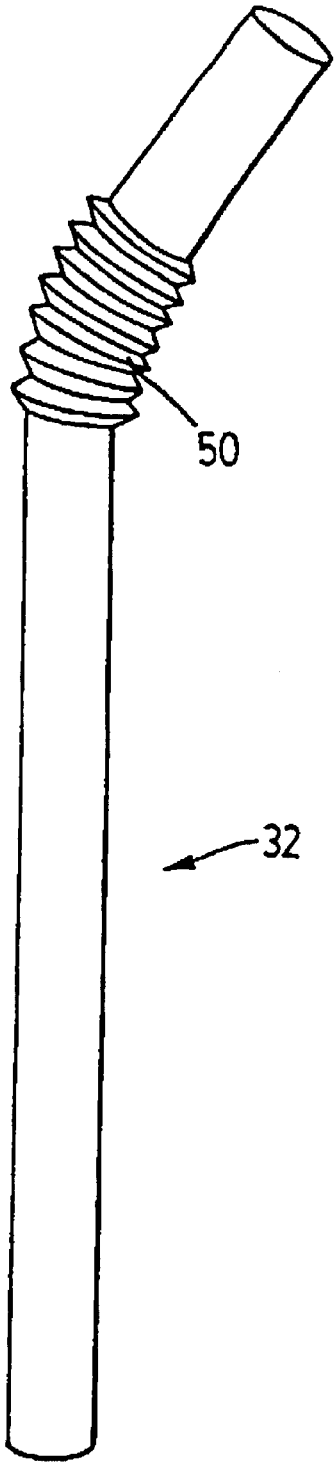
FIG. 7 is a perspective view of the drinking straw.

A drinking straw 32 as shown in FIG. 7 has a region of corrugations 50 to allow flexible manipulation of the straw 32 and to allow bending of the straw 32 without "kinking" or damaging the straw 32.

Figure 24:
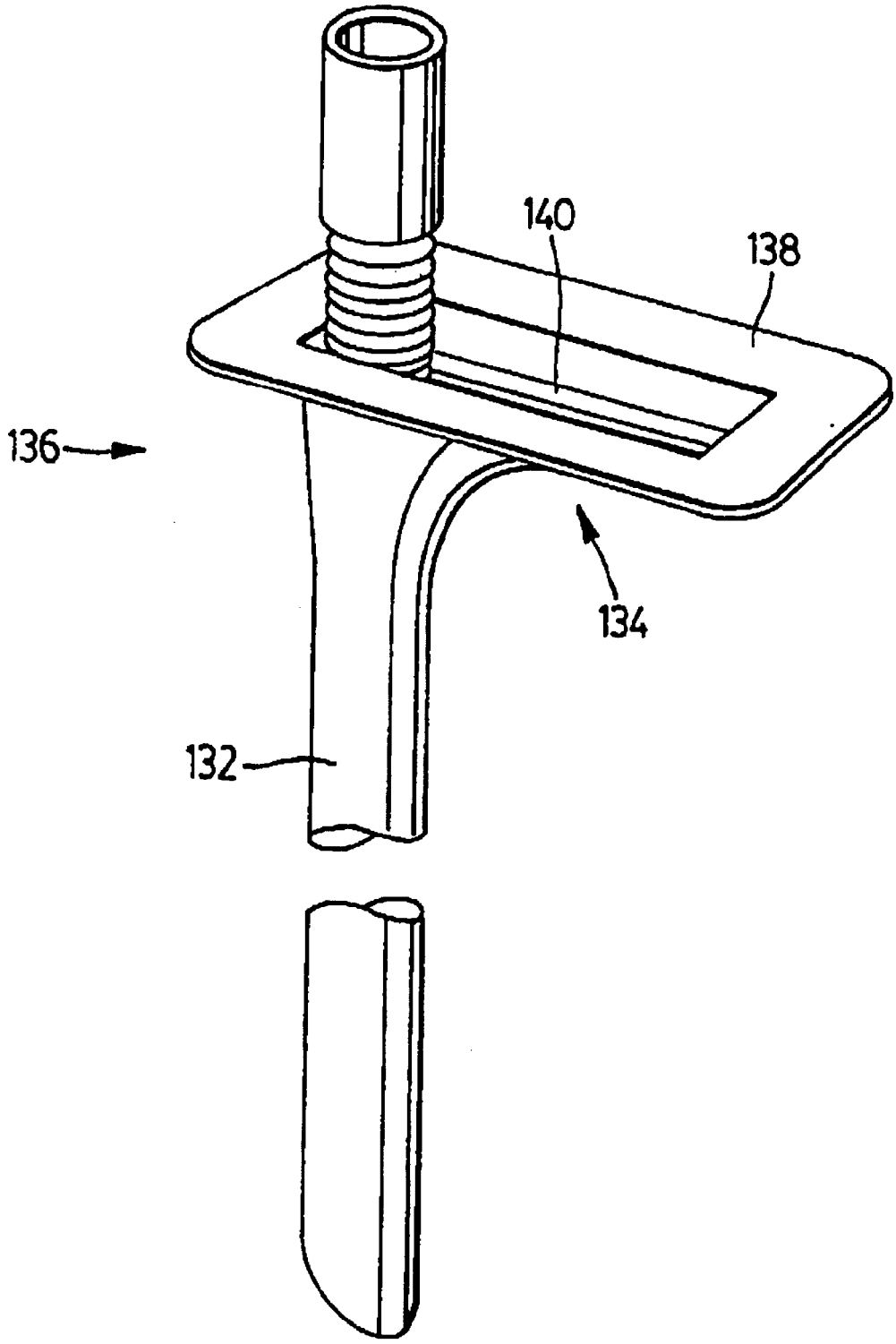
FIG. 24 is a perspective view of an alternate embodiment of the holder, straw and strip assembly of the present invention wherein the holder and straw are integrally attached.

Referring to FIG. 24 an alternate embodiment is shown wherein the straw portion 132 and the holder portion 134 are integrally attached to form a unitary straw/holder 136. The holder portion 134 has a peripheral flange 138 to allow attachment to the material 48 and strip 52. A trough 140 is formed in the holder portion to allow the upper portion of the straw portion 132 to be stowed. A vent hole (not shown in FIG. 24) is formed in the holder portion of unitary straw/holder 136 to allow atmospheric pressure to enter the container during use. Hereinafter the preferred embodiment of the separate straw 32 and holder 34 will be discussed but it will be appreciated by those skilled in the art that straw 32 and holder 34 could be replaced by unitary straw/holder 136.

The holder 34, straw 32 and strip 52 can be preassembled as an assembly 56 shown in FIG. 5. Referring to FIG. 4, preferably, the assembly 56 is attached to the lining 62 of material 48 as described in more detail below. The assembly 56 is attached to the material 48 around the perimeter of an oblong hole 60 that has been precut in the sheet packaging material 48. The assembly 56 is attached to the lining 62 of the material 48 at the flange 46 of the holder 34 so that there is a liquid and gas tight, mechanically sound seal. For a lining 62 of plastic and a holder 34 also of similar plastic, welding may be used as the method of fastening. It will be appreciated by those skilled in the art that other types of seals may be used to achieve a liquid and gas tight seal that is mechanically sound which would be included within the scope of this invention.

FIGS. 4 and 5 illustrate the straw 32 positioned in the holder 34 and the strip 52 covering the top portion of the straw 32. The strip 52 is attached to the flange 46 of the holder 34 leaving an extent of the flange 46 uncovered around the perimeter of the strip 52. A tab 54 which is an extension of the strip 52 may be provided to facilitate removal of the strip 52 by the consumer. The attachment of the strip 52 to the flange 46 is a liquid and gas tight seal which allows for the removal of the strip 52 as the consumer peels the strip 52 off by pulling on tab 54. Preferably the inside depth of trough 36 of the holder 34 does not exceed the outside diameter of the drinking straw 32 so as to provide a straw 32 that is easily accessed upon removal of the strip 52 by the consumer. In contrast the depth of the trough 36 should not be so small that the straw 32 exerts stress on the strip 52 as it keeps the drinking straw 32 in the stowed position.

Figure 6:
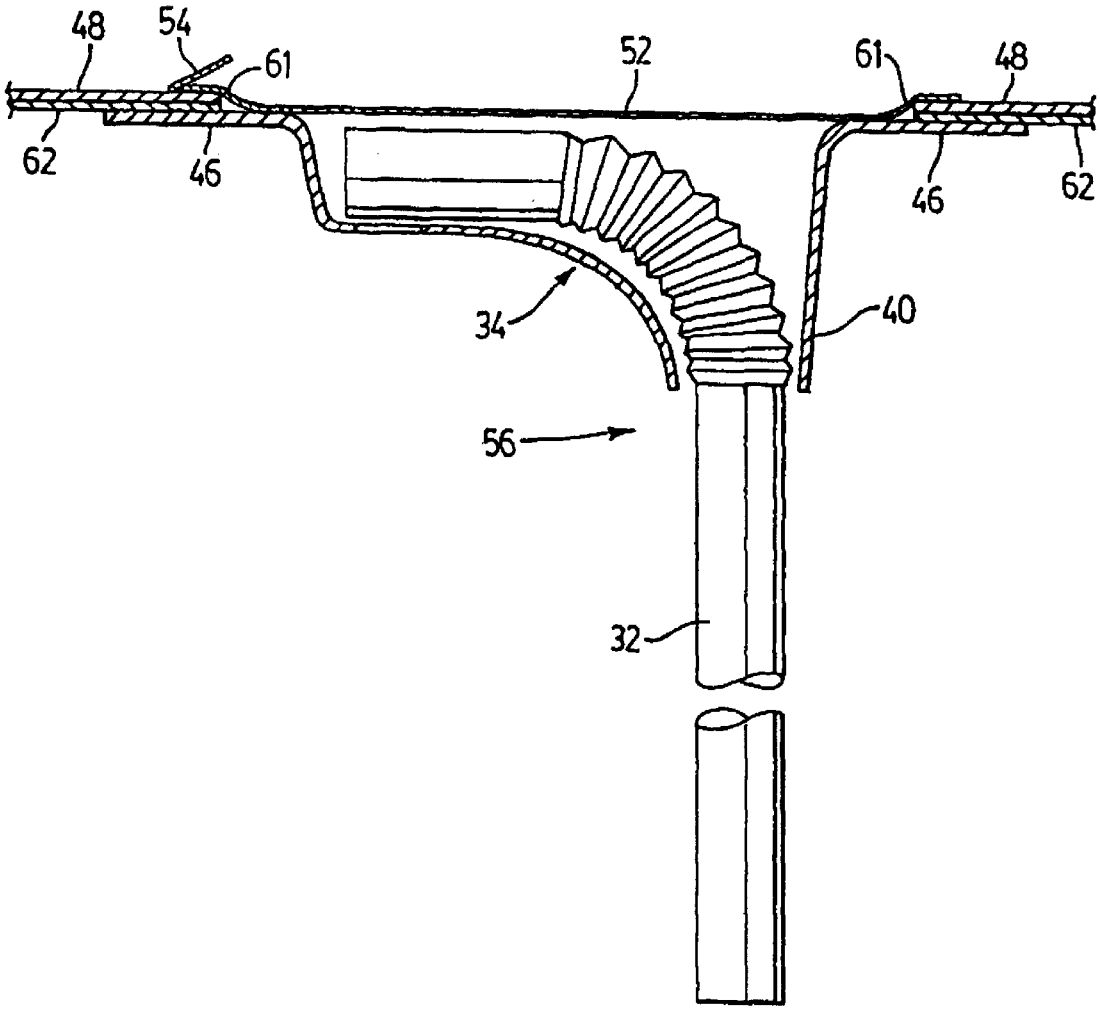
FIG. 6 is a sectional view of the assembly attached to the inner surface of the sheet material showing an alternate arrangement for the strip.

Alternatively, referring to FIG. 6, the strip 52 could be applied over the trough 36 to the flange 46 of the holder 34 after the holder 34 is attached to the lining 62 of the packaging material 48 and that the strip 52 could also be applied over a portion of the outside of the packaging material 48 around the perimeter of the oblong hole 60.

Both sides of strip 52 and tab 54 may be used for advertising or promotional material or the like.

Preferably, the unsealed margin 61 of the packaging material 48 at the oblong hole 60 is not exposed to the liquid contents of the finished carton 30. Accordingly, as shown in FIG. 4 where the strip 52 is attached with a liquid and gas tight seal to the flange 46 leaving free an extent of the flange 46, margin 61 is not exposed to the liquid contents. Similarly as shown in FIG. 6 where the strip 52 is attached with a liquid and gas tight seal to the flange 46 and the material 48 margin 61 is not exposed to the liquid contents. Alternatively margin 61 may be sealed with a plastic coating or the like (not shown). A plastic seal may be attached around oblong hole 60 over flange 46, prior to attaching strip 52.

Figure 8:
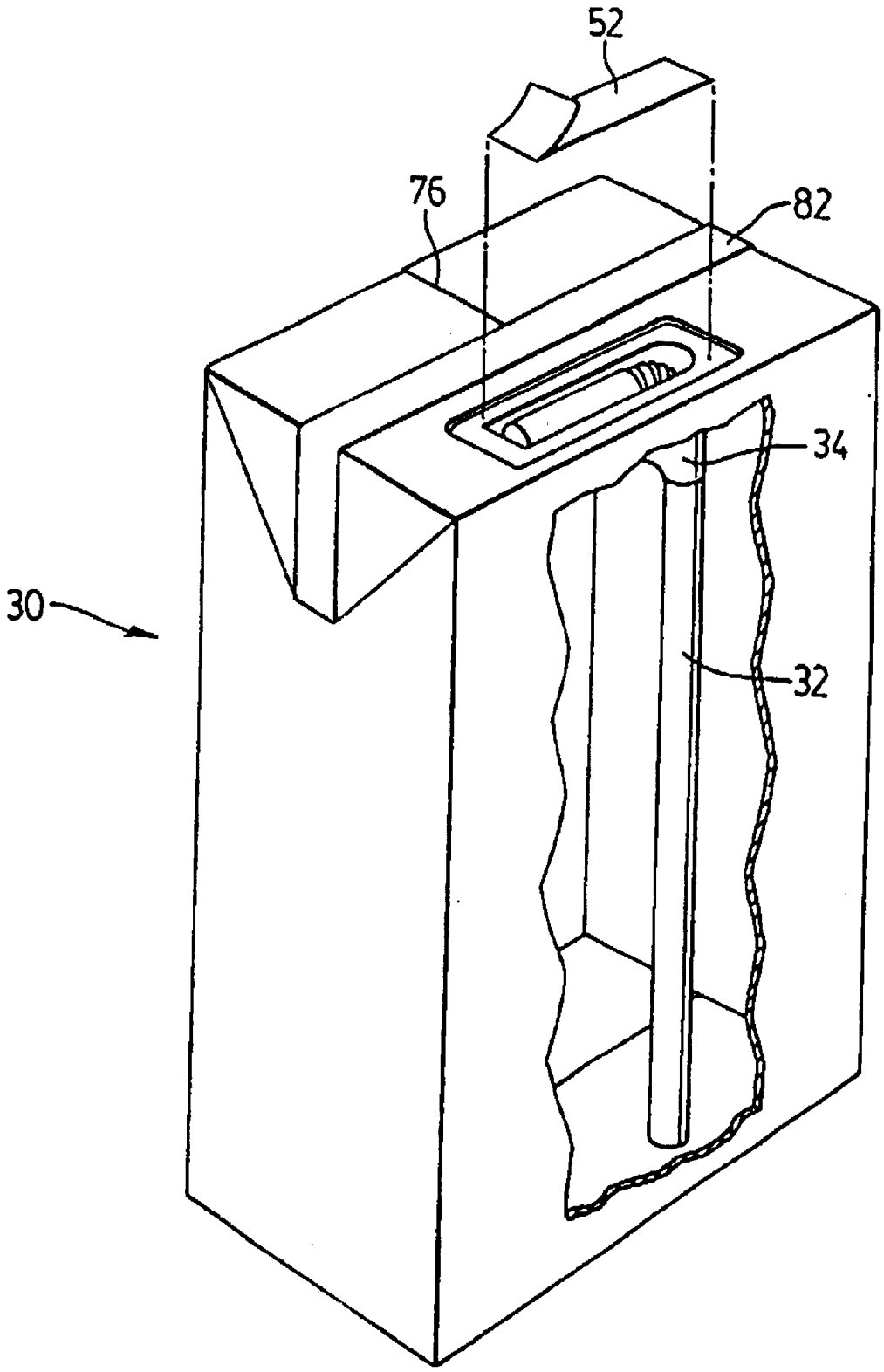
FIG. 8 is a perspective view of the carton in FIG. 1 with the strip shown exploded.
Figure 9:
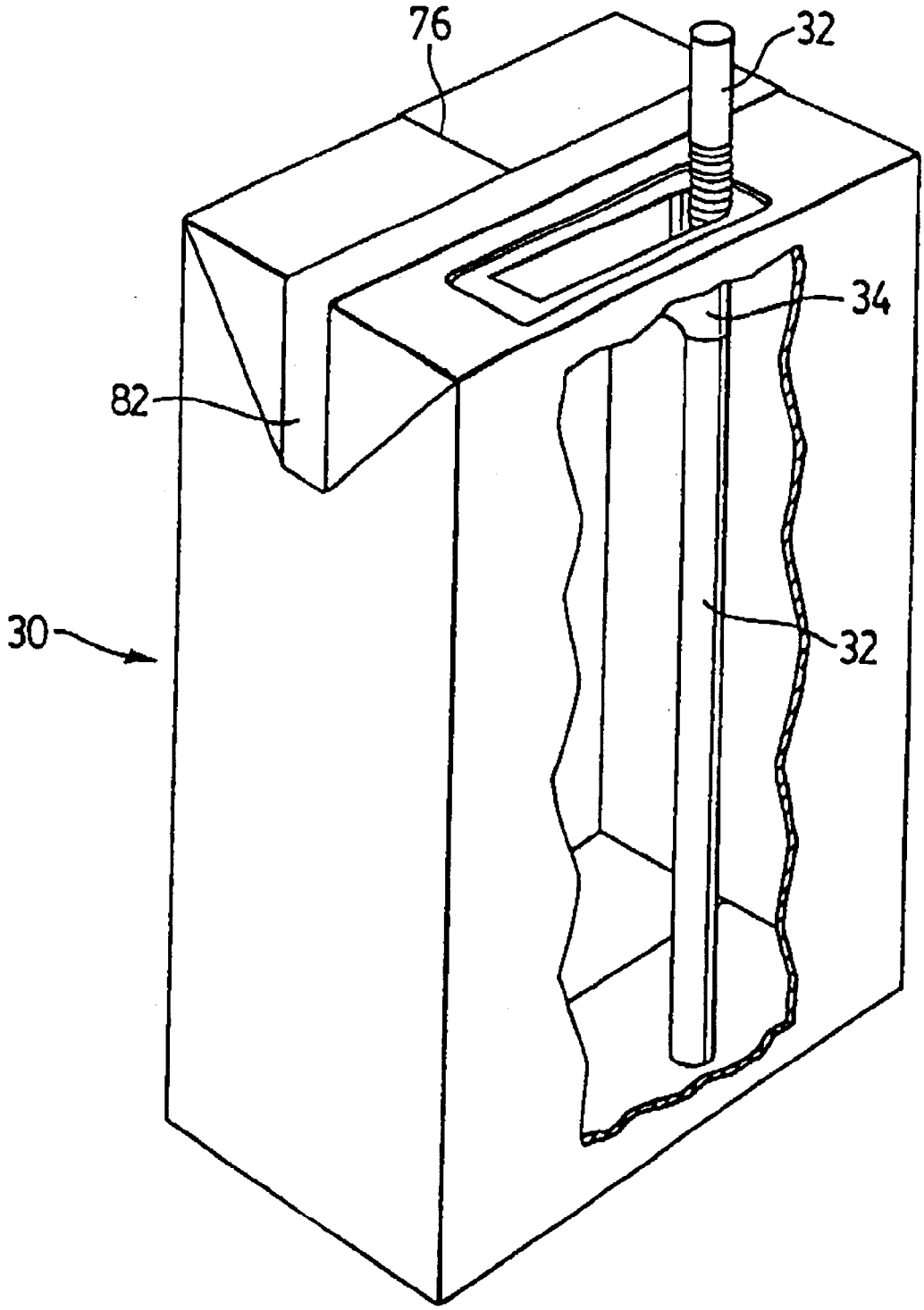
FIG. 9 is a perspective view of the carton in FIG. 1 with the strip removed and the straw raised.

FIG. 1 shows the carton 30 as the consumer would receive it, FIG. 8 shows carton 30 with the strip 52 removed and with the top portion of the straw 32 accessible but still in the stowed position and further, FIG. 9 shows the straw 32 raised into the drinking position.

Preferably the finished beverage carton 30, as shown in FIGS. 1, 8 and 9 has the transverse seam 82 at the top of the carton 30 folded so that the longitudinal seam 76 is folded back on itself. This folding arrangement will allow the greatest uninterrupted width at the top of the carton 30 for the application of the assembly 56.

Figure 10:
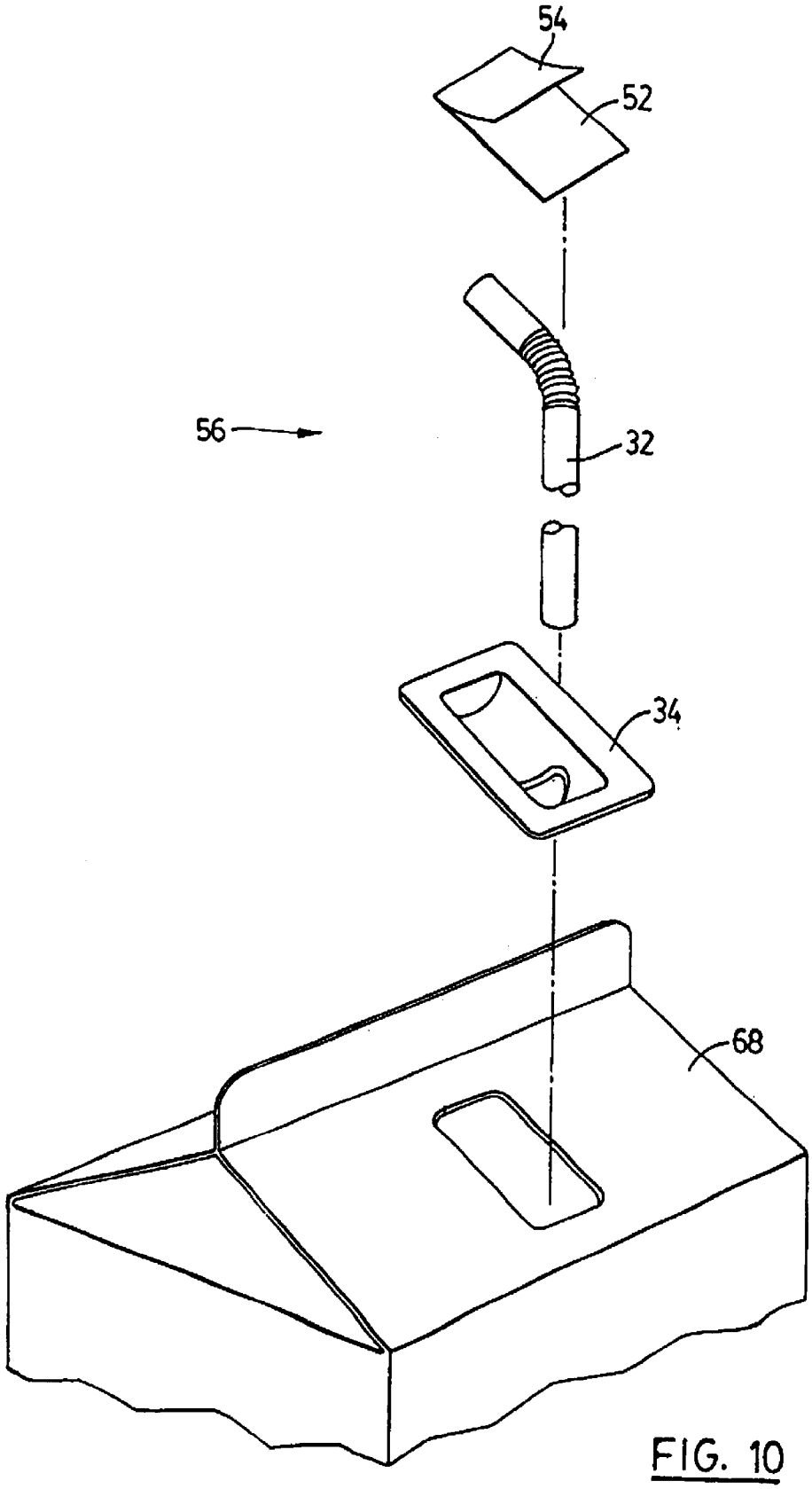
FIG. 10 is an exploded partial perspective view of the assembly of the present invention shown applied to a gable top carton.
Figure 11:
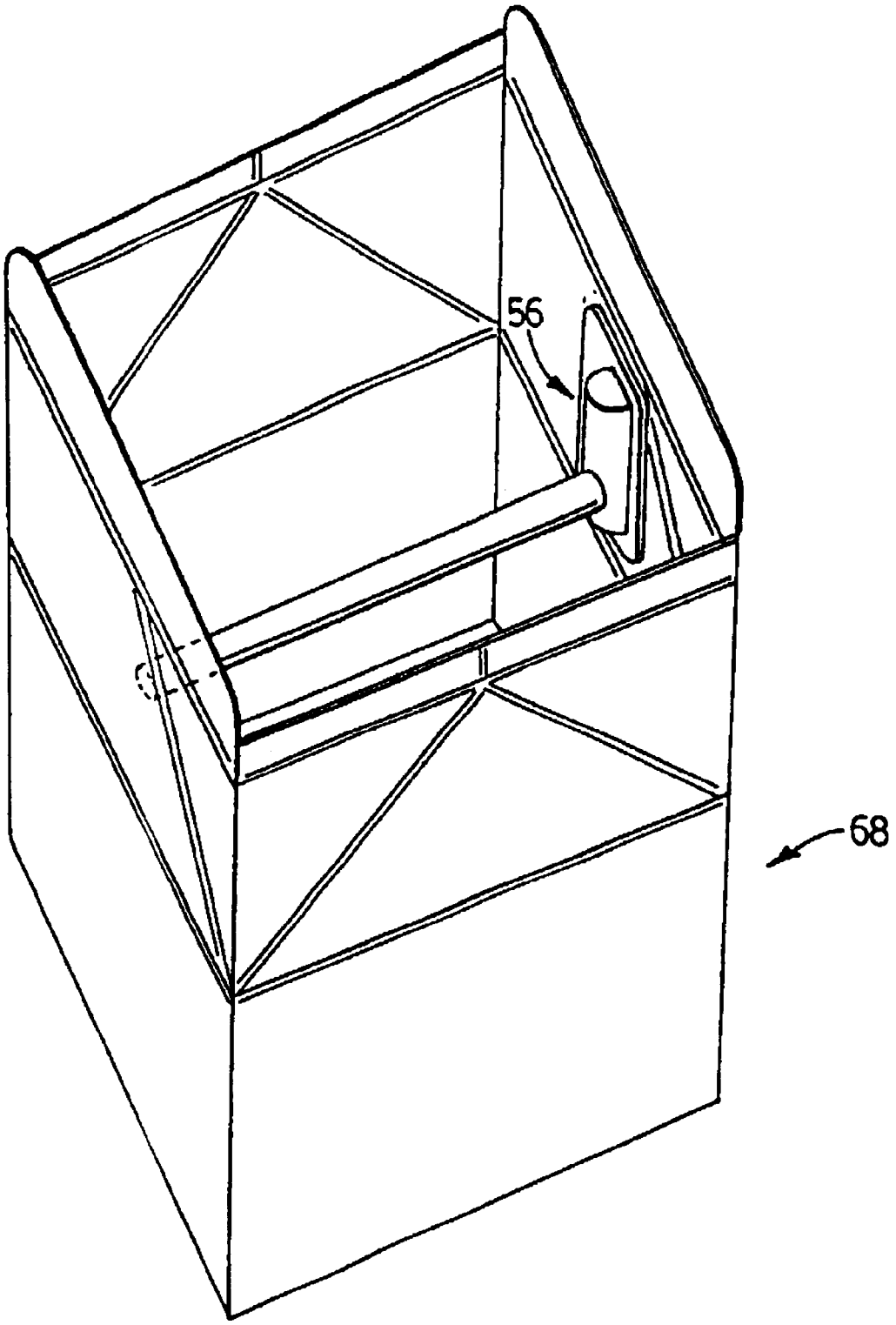
FIG. 11 is a perspective view of the assembly of the present invention shown applied to the inner surface of a partially formed gable top carton.
Figure 12:
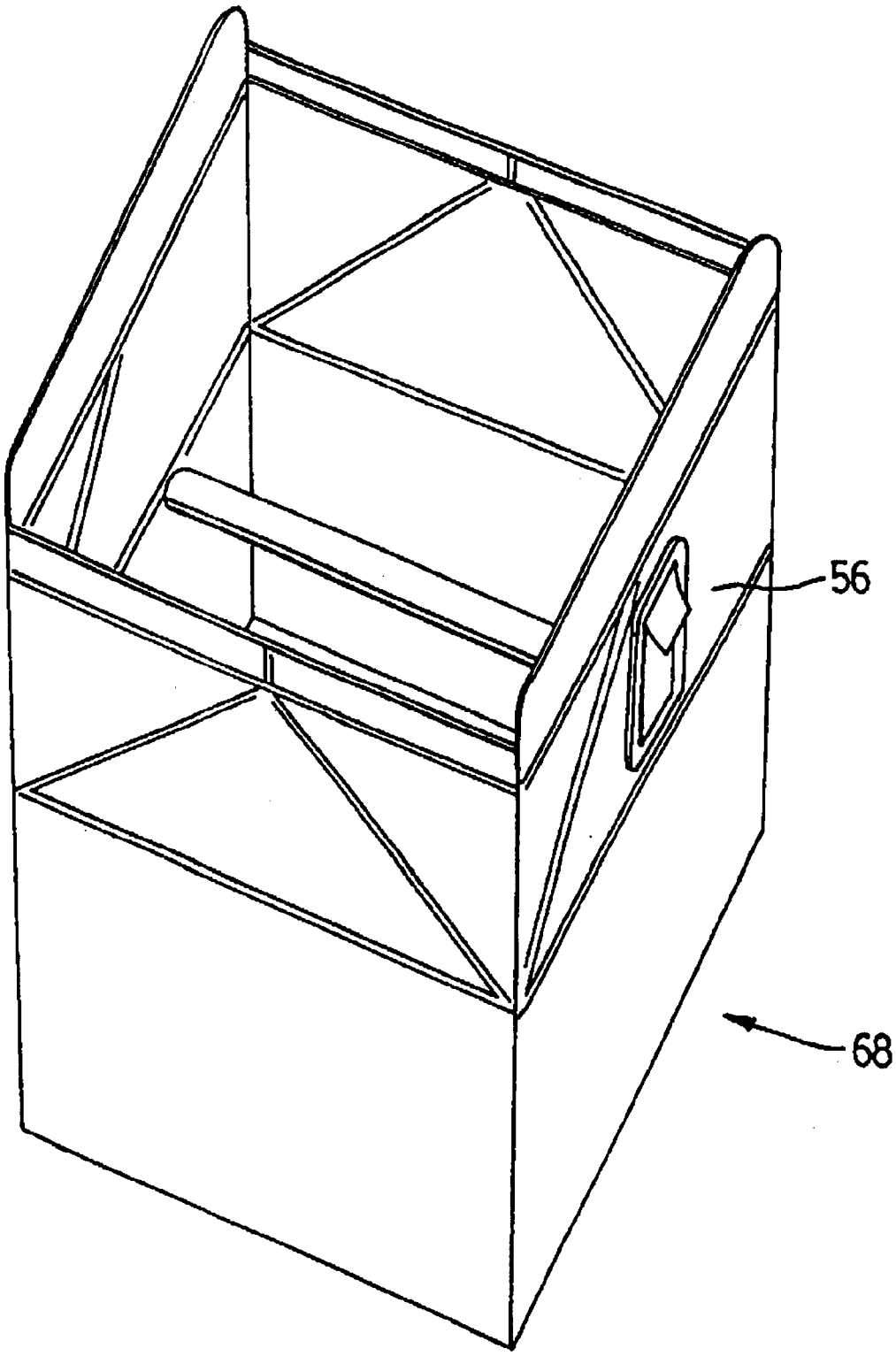
FIG. 12 is a perspective view similar to FIG. 11 but showing the assembly applied to the outer surface of a partially formed gable top carton.
Figure 13:
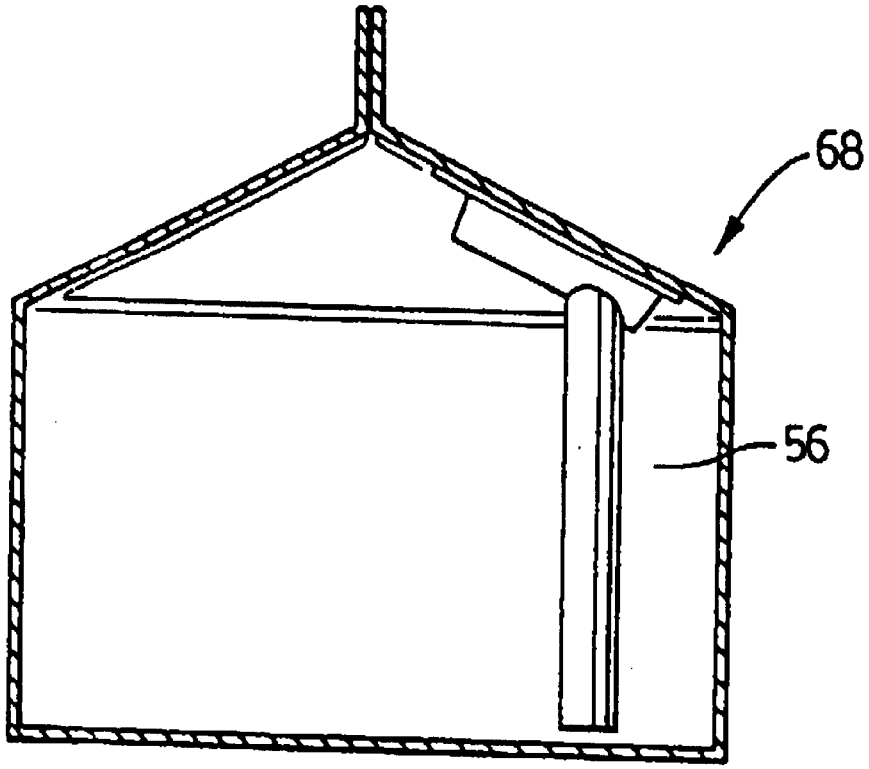
FIG. 13 is a sectional view of a gable top carton showing the assembly of the present invention attached to the inside surface of the gable top carton.

As a further application of the holder 34, straw 32 and strip 52, FIG. 10 illustrates how the assembly 56 could be adapted for a gable top carton 68. The assembly 56 could be applied to the inside of the carton 68 before the carton is filled and closed, as shown in FIG. 11 or alternatively, assembly 56 could be applied to the outside of the carton 68 before the carton is filled and closed, as shown in FIG. 12. A filled and closed carton 68 is illustrated in FIG. 13 with assembly 56 attached to the carton 68.

Figure 20:
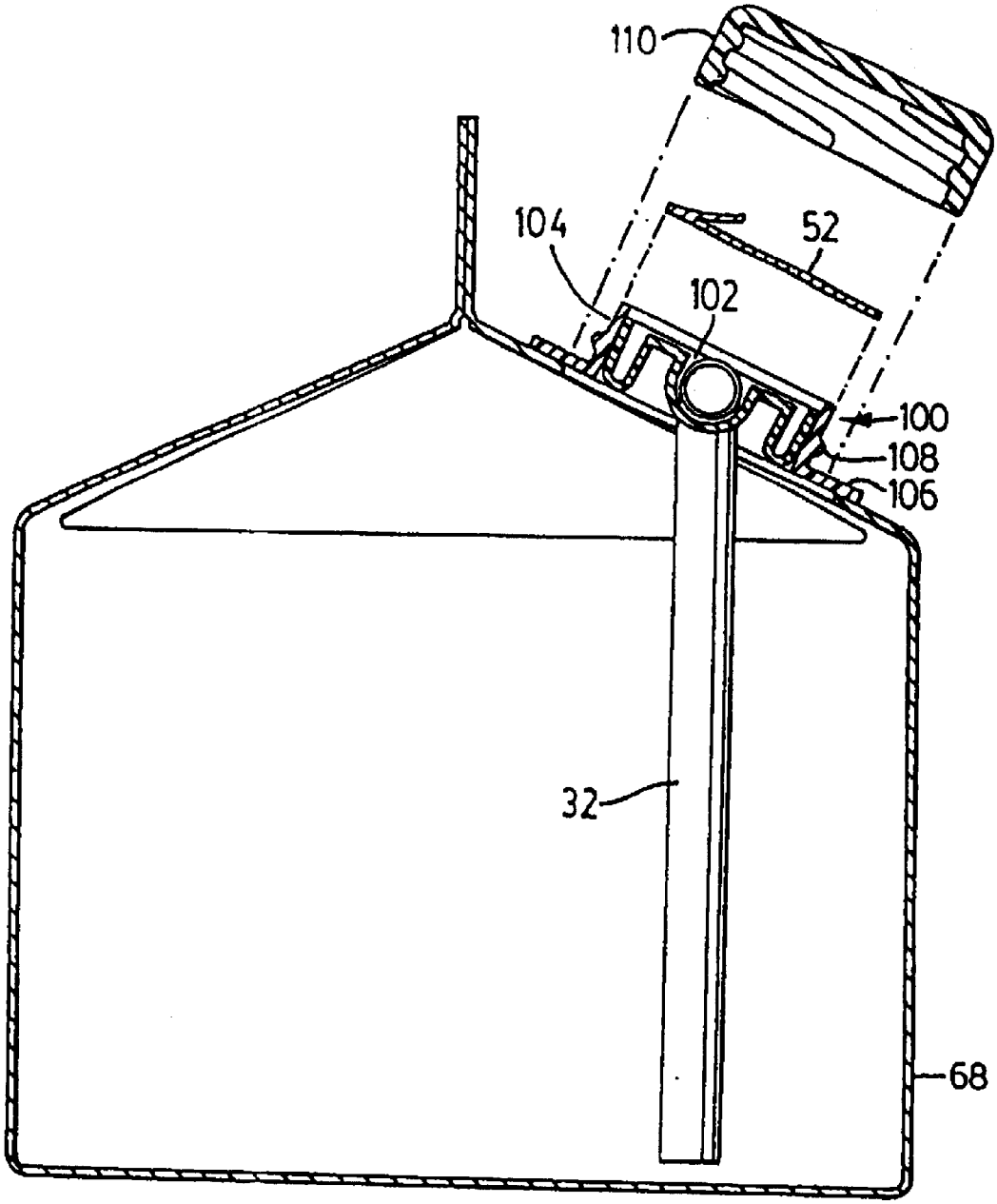
FIG. 20 is a cross sectional view of a holder/straw assembly of the present invention shown in a side spout of a gable type carton beverage container with an expandable bendable straw positioned therein.
Figure 21:
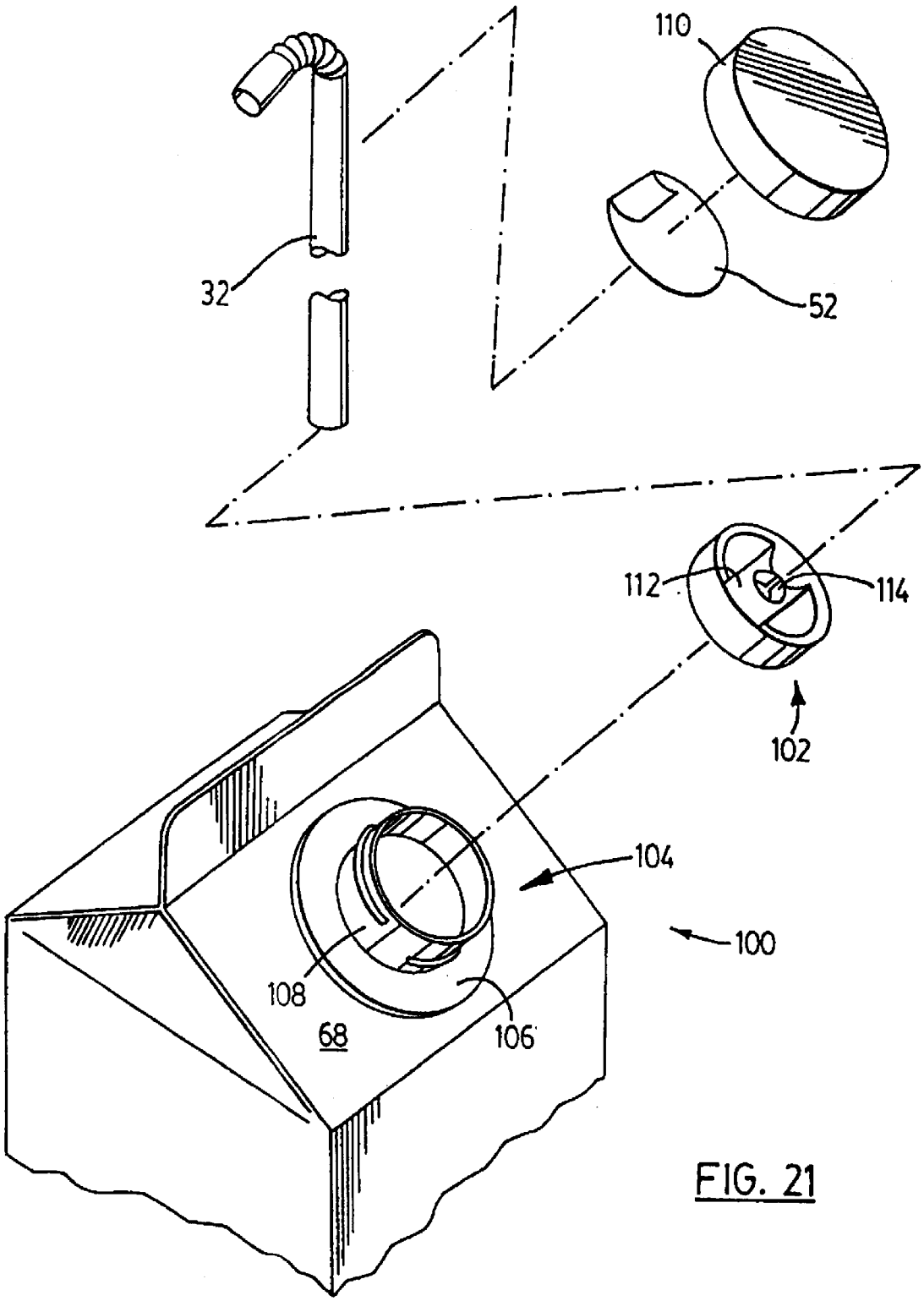
FIG. 21 is an enlarged blown apart broken away perspective view of the holder/straw assembly of FIG. 20.

As an additional embodiment of the holder and strip, a resealable adaptation is illustrated in FIGS. 20 and 21 and shown in a gable top carton 68. Holder assembly 100 shown therein has a removable inner portion 102 and an outer portion 104. The outer portion 104 has a flange 106 which is attached to the carton 68. Outer portion 104 has outer threads 108 which are adapted to engage a cap 110. Inner portion 102, outer portion 104 and cap 110 are generally circular. Inner portion 102 has a trough 112 and an aperture 114 for receiving straw 32. A strip 52 is affixed to inner portion 102 over straw 32.

Referring to FIG. 21, the outer portion 104 is positioned in a gable topped carton 68. The inner portion 102 is positioned in the outer portion 104. Straw 32 is positioned in inner portion 102. Strip 52 is attached to inner portion 102 or outer portion 104. Cap 110 is attached to outer portion 104.

Assembly of the holder assembly 100 including inner portion 102, straw 32 and strip 52 in the outer portion 104 could occur either before or after the outer portion 104 is attached to the carton 68. Inner portion 102 could be positioned in any rotational attitude, either with the trough 112 being horizontal, as in FIGS. 20 and 21 or sloped, with the aperture 114 either proximate to the upper or lower edge of the outer portion 104. The strip 52 as discussed above would be attached so as to provide a liquid and gas tight seal.

Figure 22:
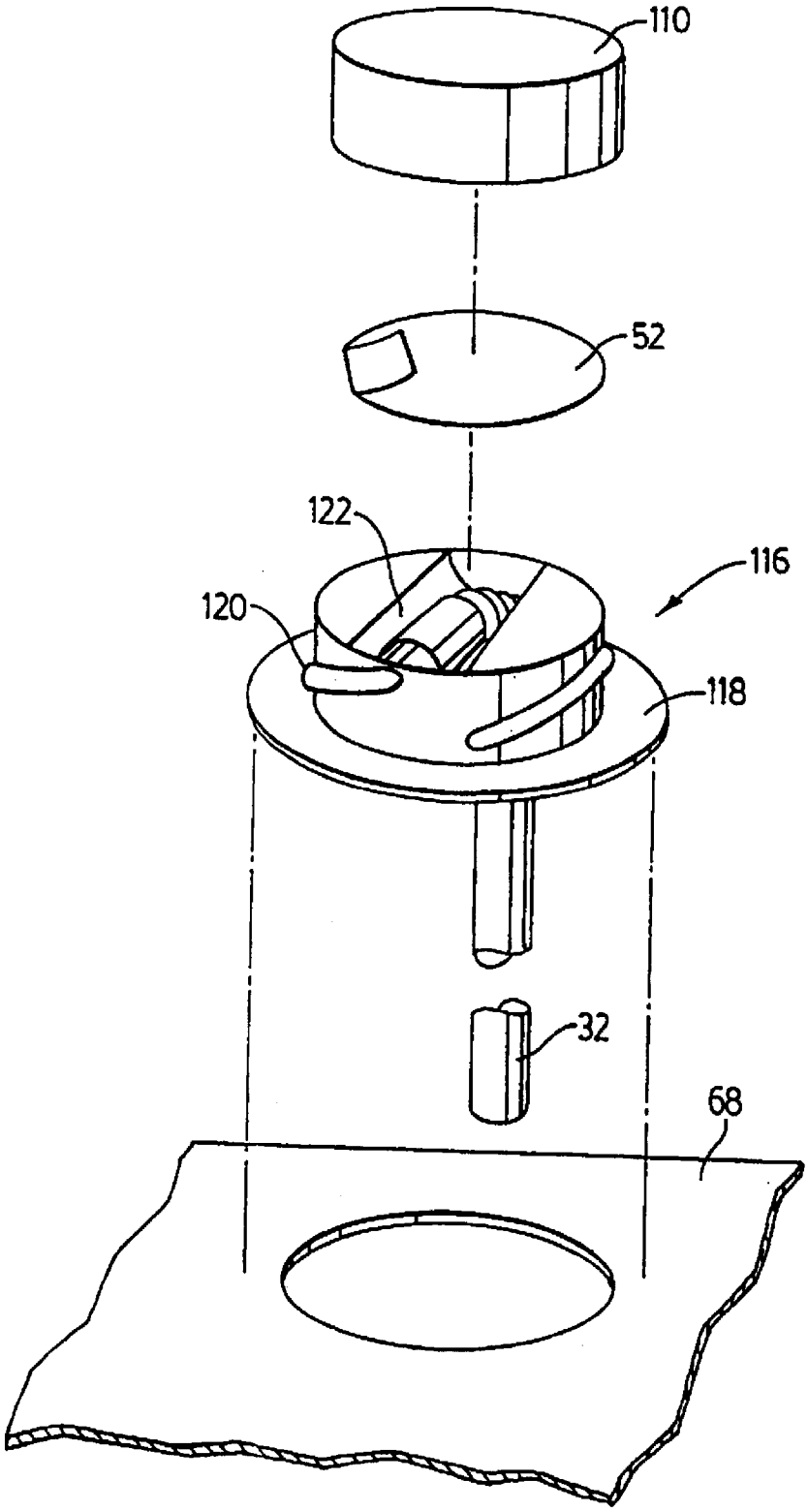
FIG. 22 is an exploded perspective view of an alternative embodiment of the holder/straw assembly of the present invention, shown with a resealable threaded cap and sheet packaging material with a circular cut out hole therein.

Referring to FIG. 22, holder 116 is similar to holder assembly 100 but there is not a separate outer portion and inner portion. Holder 116 has a flange 118, outer threads 120, a trough 122 and an aperture (not shown).

Referring to FIG. 23, as an alternative, the inner portion 124 and straw portion 126 could be integrally attached as shown generally at 128. Similar to the above inner holder 102 described above inner portion 128 would have a press fit into an outer portion 104. The straw portion 126 would be flexible such that if on installation the straw would touch the bottom of the carton the straw would flex so that the inner portion could still fit tightly into the carton. Straw portion 126 has a bevelled end 130 to minimize the chance of the user sucking on the straw such that it sticks to the bottom of the carton and no liquid can enter therein. Straw 32 could be similarly adapted.

Figure 25:
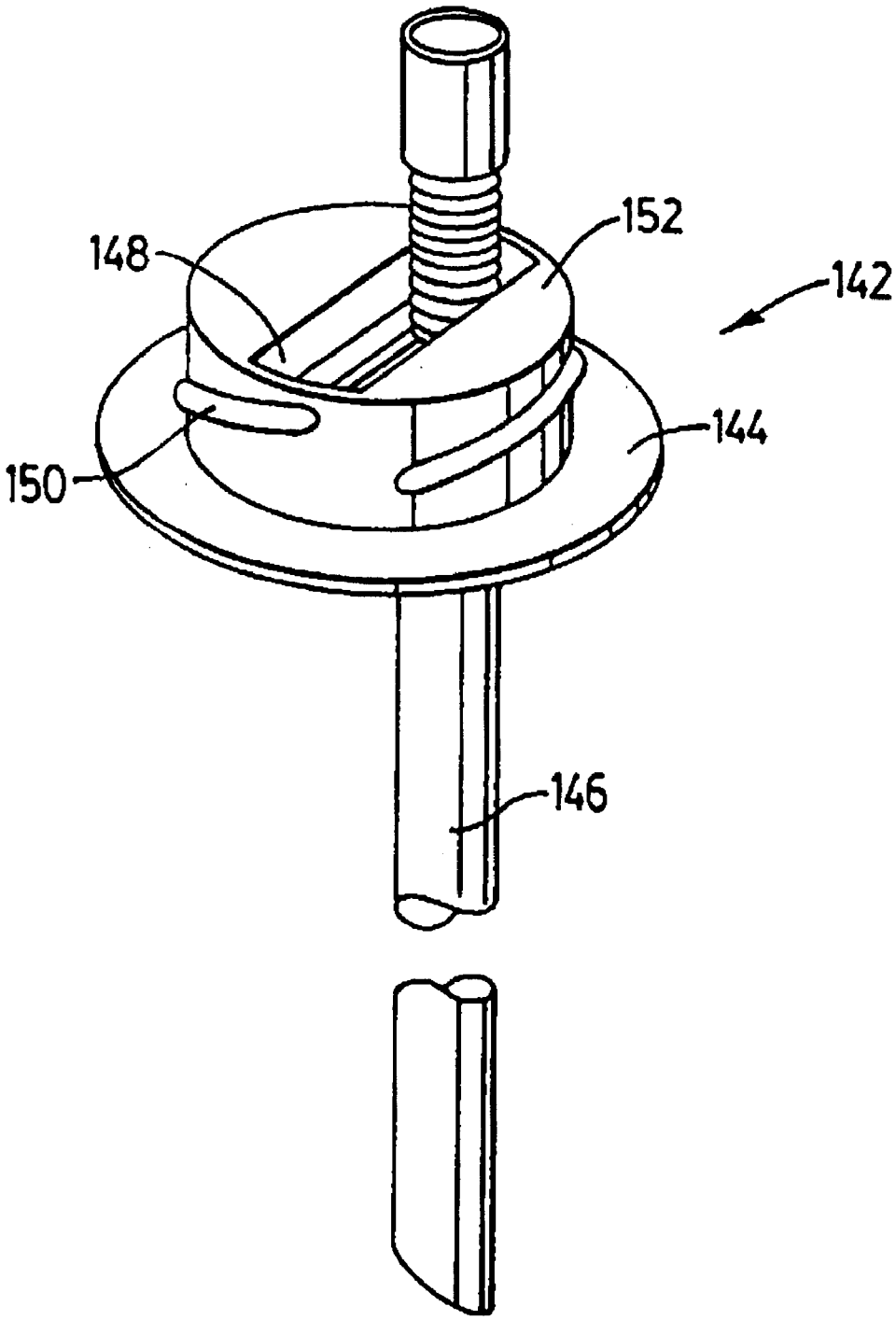
FIG. 25 is a perspective view of an alternate embodiment of the threaded holder of the holder/straw assembly of the present invention, wherein the holder and straw are integrally attached.

Referring to FIG. 25, alternatively the holder portion 152, straw portion 146 and flange 144 are integrally attached to form a unitary resealable straw/holder 142. Unitary resealable straw/holder 142 has outer threads 150 for receiving a cap (not shown) thereon and a trough 148 for receiving the upper portion of straw portion 146 in a stowed position. Unitary resealable straw/holder 142 could accept a strip (not shown) as discussed above.

Figure 26:
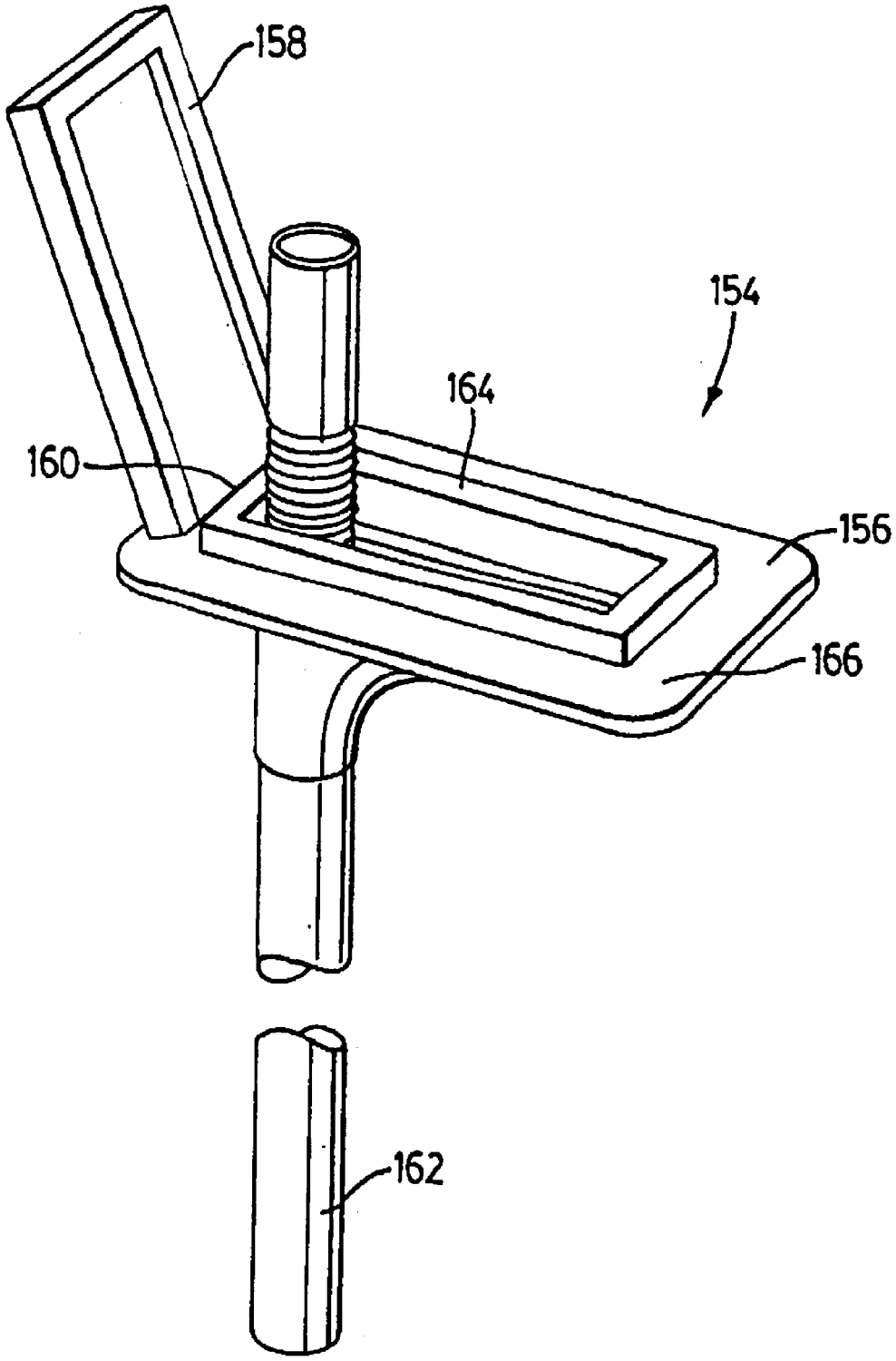
FIG. 26 is a perspective view of an alternate embodiment of the holder/straw assembly shown with a resealable flap.

Referring to FIG. 26, a further alternate holder and straw assembly 154 embodiment is shown wherein a holder 156 is adapted to include a resealable flap 158. A living hinge 160 connects the resealable flap 158 to holder 156. As described above, straw 162 may be separate or integrally attached to the holder. Holder 156 includes a trough 164 for receiving straw 162 in the stowed position and a flange 166.

It will be appreciated by those skilled in the art that liquid container, holder and straw assembly of the present invention have a number of advantages over the prior art. For example since the straw is placed on the inside of the container prior to the container being purchased by a consumer there will be a reduced likelihood of spillage since the user need not pierce the container with the straw. A further advantage is that the straw will not obscure any printed material that is on the outside of the container. A further advantage is that by providing the straw on the inside of the container there is no longer a need for a protective plastic envelope. The liquid container, holder and straw assembly of the present invention provides an aperture formed in the holder and a straw that fits snugly therein, thereby providing access to the liquid only through the straw. This configuration minimizes the likelihood of spillage during use.

Figure 14:
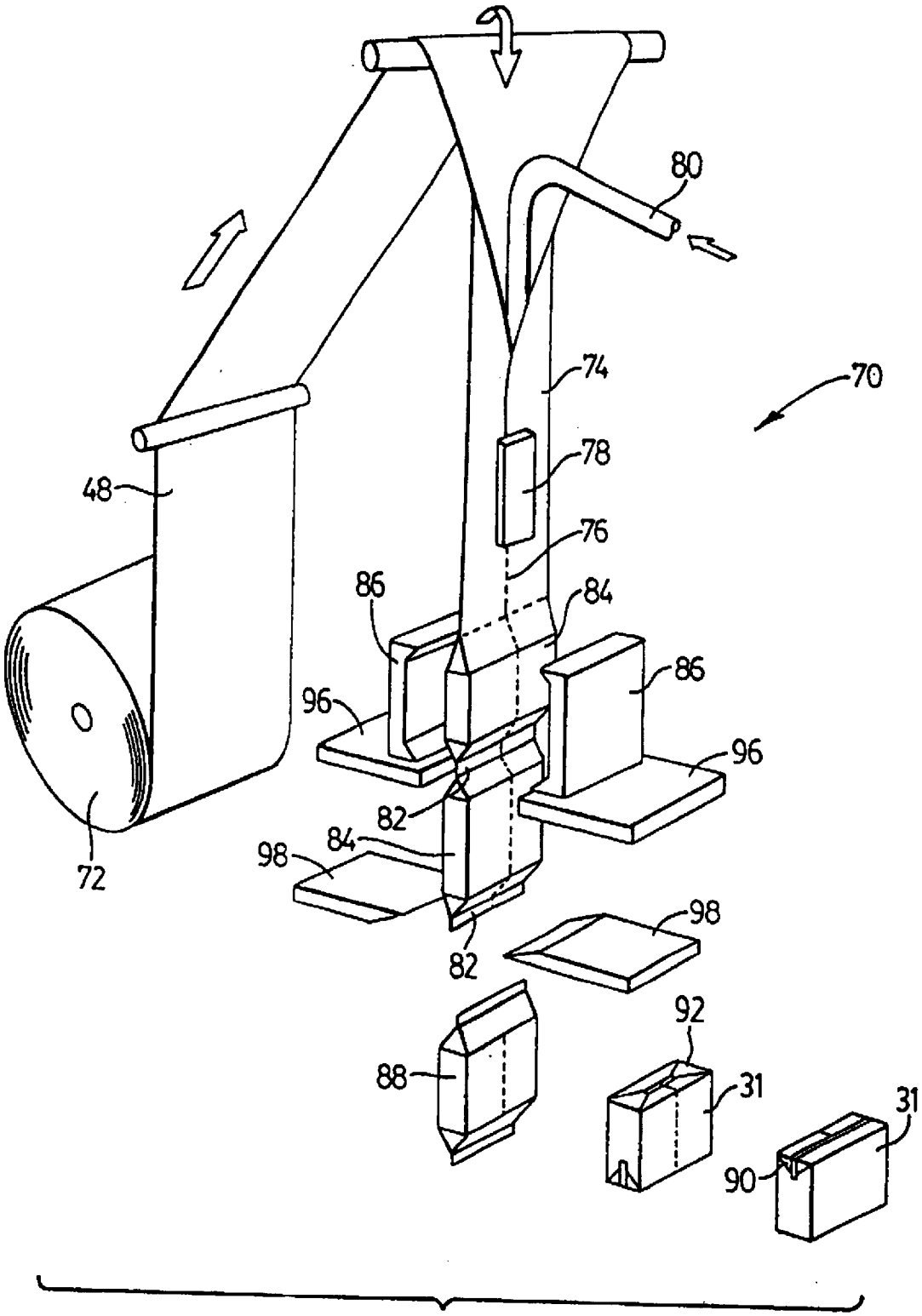
FIG. 14 is a perspective view of the prior art form, fill and seal process for manufacturing a filled carton.

Referring to FIG. 14 the prior art beverage packaging process for the manufacture of parallelepipedic boxes is shown generally at 70. The process is a form, fill and seal type process that employs a reel 72 of printed and creased sheet packaging material 48. Generally the sheet packaging material 48 is of a paper board base laminated on both surfaces with plastic to provide water impermeability. Additional laminations of plastic and aluminum may be used to further improve water and gas impermeability of the sheet material 48.

The sheet packaging material 48 is taken from the reel 72, raised and brought into a vertical orientation where the sheet is wrapped into a continuous columnar sleeve 74 and sealed at a longitudinal seam 76 by a heated sealing device 78. Beverage is added into the columnar sleeve 74 below the sealing device 78 via a pipe 80 that enters the columnar sleeve 74 prior to the formation of the columnar sleeve 74.

At intervals that establish individual cartons of beverage, a transverse seam 82 is formed across the columnar sleeve 74 and through the beverage by sealing jaws 96. The lower portion of the columnar sleeve 74 is roughly formed into an individual carton 84 by forming dies 86 and is then cut from the columnar sleeve 74 by cutting jaws 98. The top and bottom flaps of the cut off cartons 88 are folded, the top flaps 90 are secured to the sides of the carton and the bottom flaps 92 are secured to the bottom of the carton to form the finished carton 31 as described above. It will be appreciated by those skilled in the art that only the basic steps of the form, fill and seal process are shown. For example other pairs of forming dies are required to transform the cut off carton 88, as cut from the columnar sleeve 74, from its cushion shape to the parallelepipedic carton 31 shape.

Referring to FIGS. 15–19, the above described process has been adapted to include the application of assembly 56. Tooling (not shown) bears on the flange 46 of the holder 34 during the application of the assembly 56 to the lining 62 of the boxboard material 48 at the perimeter of the oblong hole 60. As it is required that the sheet material 48 be wrapped from a flat sheet into the columnar sleeve 74 it will also be required that the assemblies 56 attached to the material 48 be temporarily moved to keep the extended straws 32 from interfering with the forming and sealing of the columnar sleeve 74.

Figure 16:
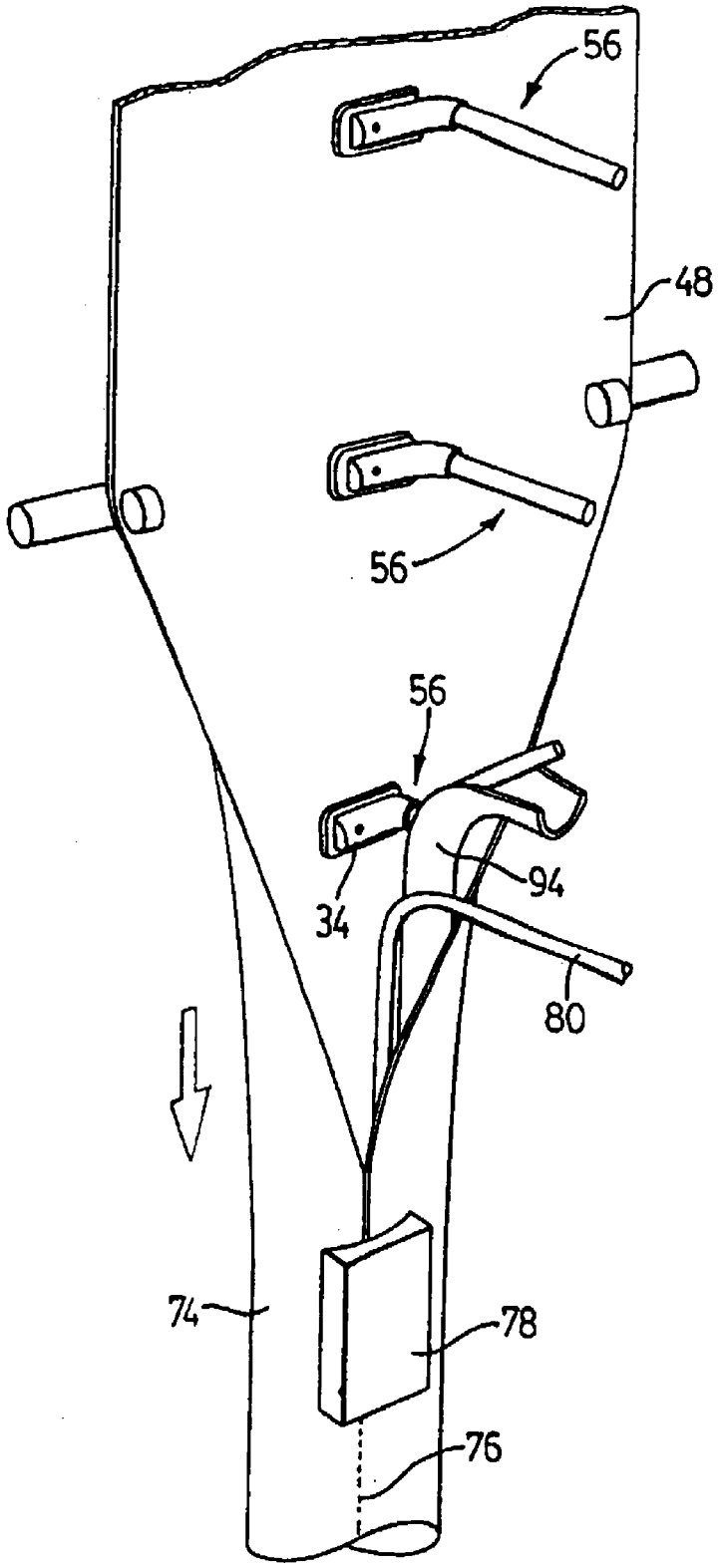
FIG. 16 is an enlarged perspective view of that portion of the form, fill and seal process of the present invention wherein the assembly is attached and the straw is moved so as not to interfere with the continuous sheet being formed and sealed into a column.
Figure 17:
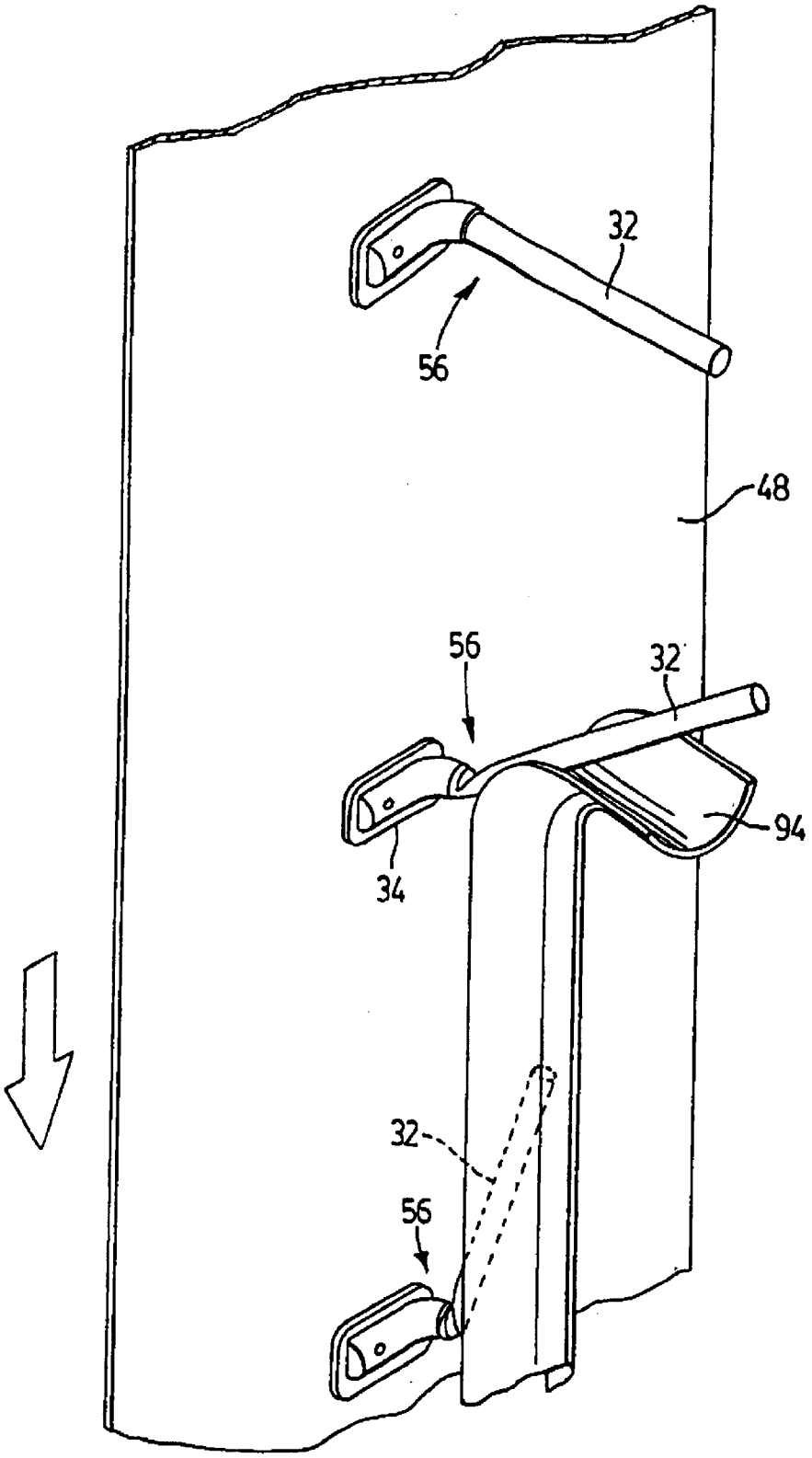
FIG. 17 is an enlarged perspective view of the continuous sheet with assemblies attached thereto and a straw shown engaging a guide.
Figure 18:
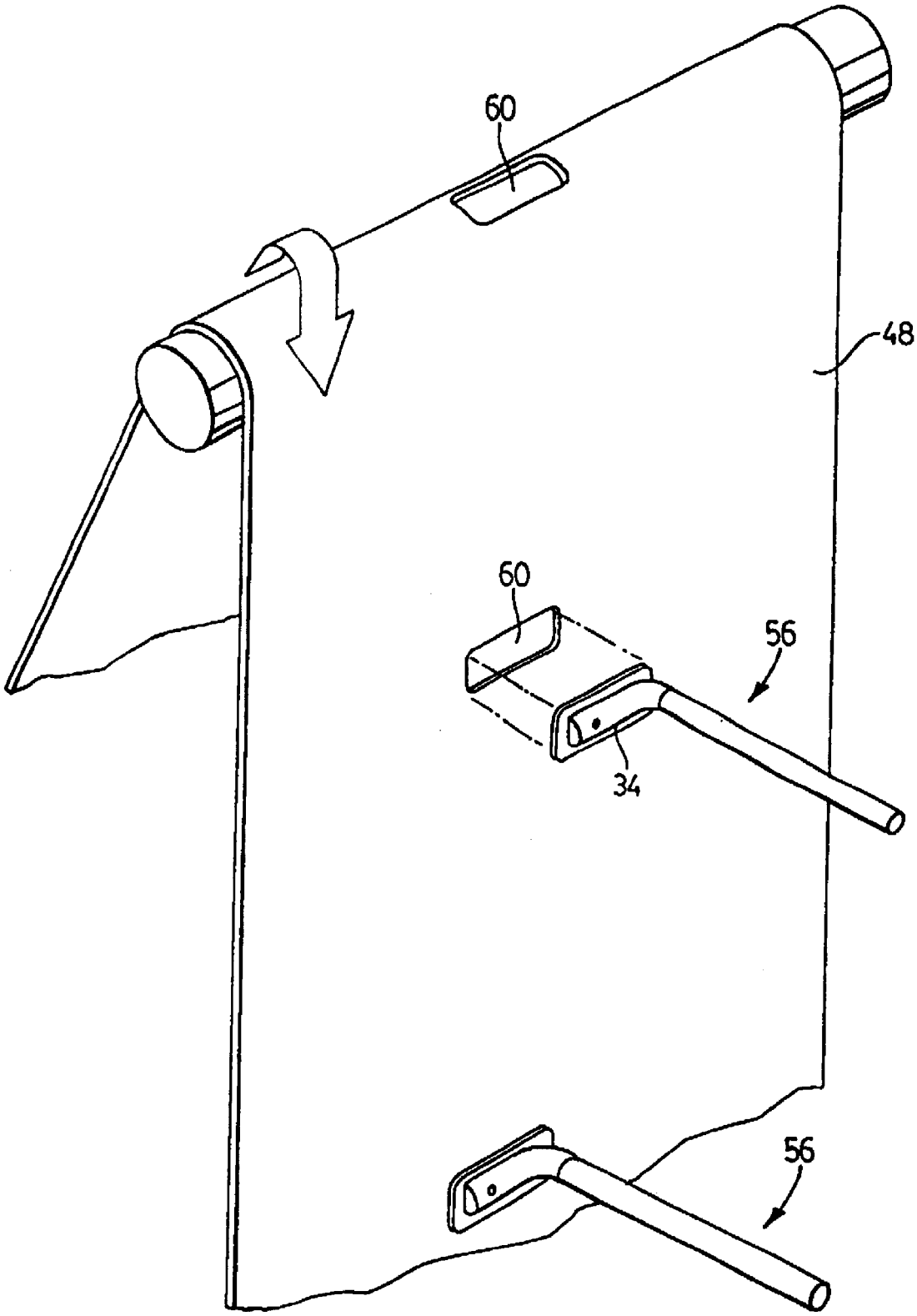
FIG. 18 is an enlarged perspective view showing attachment of the assembly to a continuous sheet material.
Figure 19:
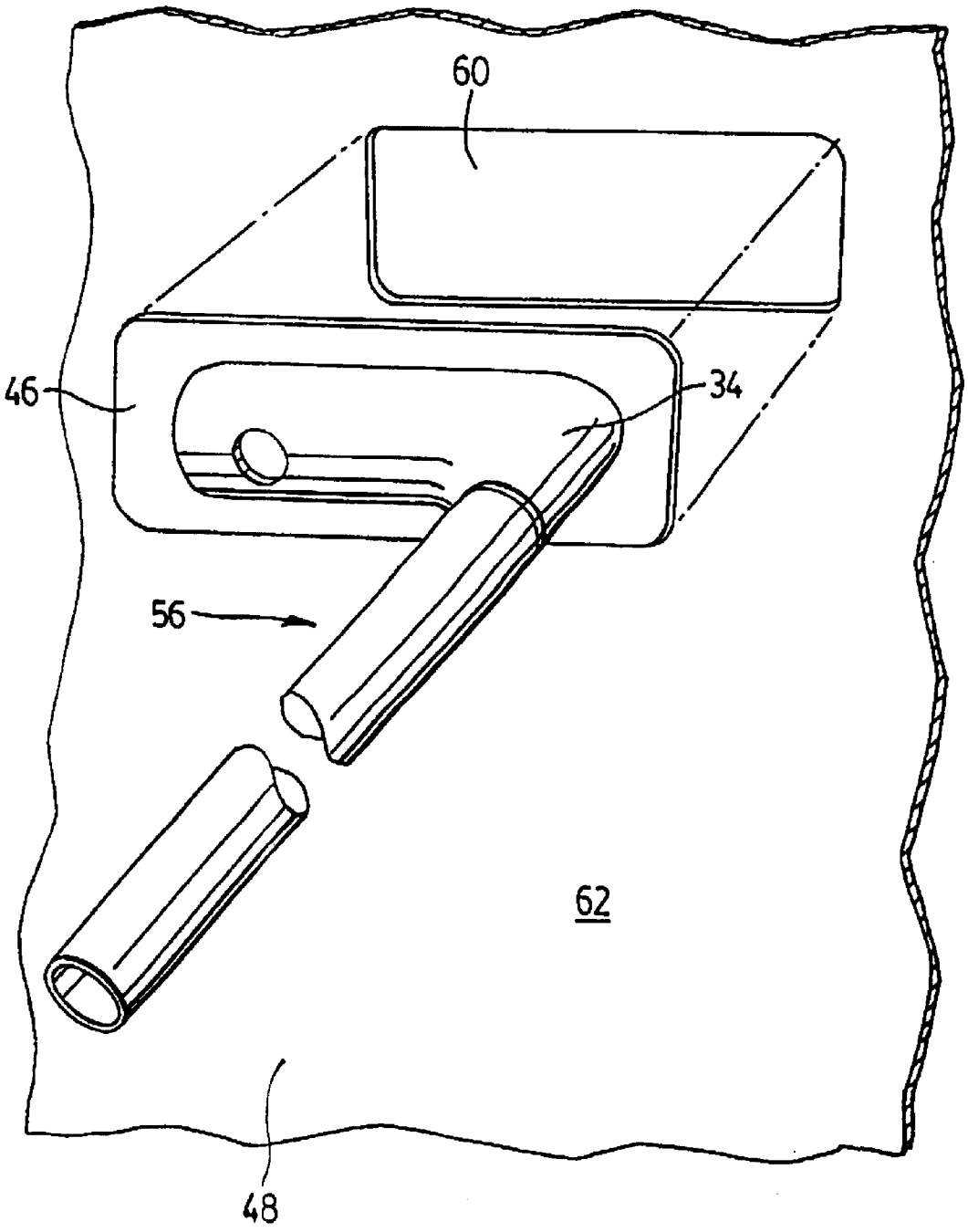
FIG. 19 is an enlarged perspective view showing attachment of the assembly to the sheet material of the carton.

A guide 94 which is generally an elongate "L"-shaped guide and which is generally "U"-shaped in cross section is illustrated in FIGS. 16 and 17 to temporarily move the straws 32 and to keep each clear of the wrapping and sealing process. The guide 94 will extend into the columnar sleeve 74 along with the beverage pipe 80. The longitudinal seam 76 and heated sealing device 78 are shown in FIG. 16 as well.

Figure 15:
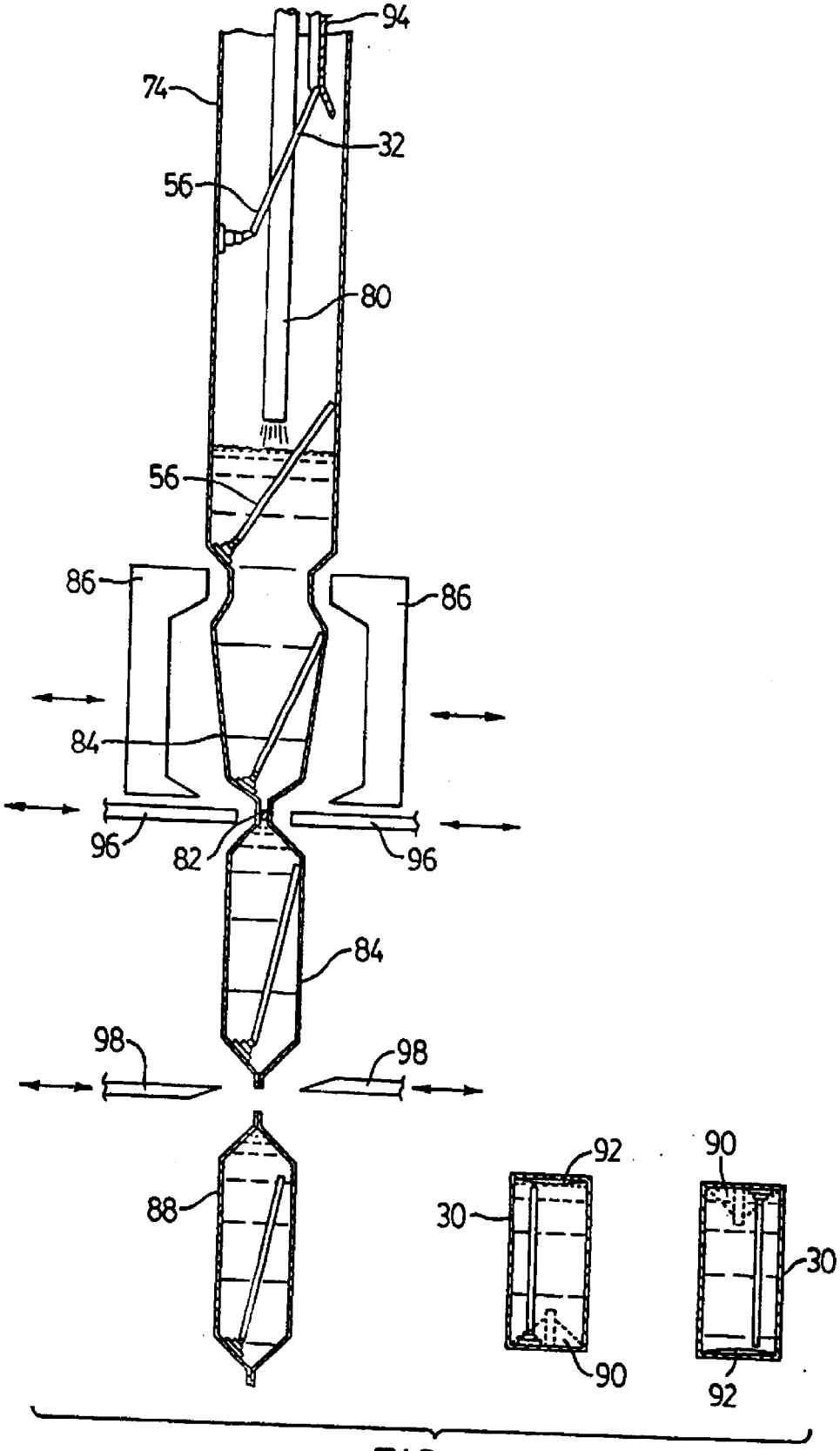
FIG. 15 is a sectional view of a portion of the form, fill and seal process, of the present invention, thereby manufacturing a filled carton with a straw therein.

At a point below the formation of the longitudinal seam 76 the guide 94 is terminated and the straw 32 is allowed to lean against the opposite wall of the columnar sleeve 74 as illustrated in FIG. 15. As seen in FIGS. 15, 16 and 17, a holder 34 of this thin wall design would allow both some degree of strain relief to the moved straw 32 during formation of the columnar sleeve 74 and some freedom for the consumer to redirect the drinking straw 32 to get the last drop of beverage from the carton 30 or 68.

As the columnar sleeve 74 is progressively advanced downwardly, beverage is supplied to the inside of the columnar sleeve 74 via beverage pipe 80, forming dies 86 roughly form the individual cartons 84, sealing jaws 96 form a transverse seal 82 across the columnar sleeve 74 and through the beverage and cutting jaws 98 cut the sealed individual carton 84 from the columnar sleeve 74.

The top flaps 90 and bottom flaps 92 resulting from the forming and cutting steps are folded and attached to the sides and bottom respectively of the beverage carton, to produce the finished beverage carton 30, also shown in FIG. 1.

The finished beverage carton 30 is illustrated in FIGS. 1, 8 and 9, with a partially removed side panel to better illustrate the orientation of the straw 32 inside the carton 30.

It will be appreciated by those skilled in the art that the elements of the assembly 56 shown here as being attached in one step could be attached separately. That is the holder 34 could be attached to sheet material 48 and then the straw 32 inserted therein and then sealing strip 52 attached to the holder 34 or the sheet material 48 and holder 34.

It will be appreciated that the above description related to the invention by way of example only. Many variations on the invention will be obvious to those skilled in the art and such obvious variations are within the scope of the invention as described herein whether or not expressly described.

What is claimed as the invention is:

1. A liquid container of plastic coated boxboard, or laminated cardboard comprising:

a container body having an interior volume and a plurality of exterior walls;

a holder having an aperture and a trough formed therein, the trough having a vent hole formed therein, the trough being contiguous with the aperture, the trough being dimensioned to receive a straw in a stowed position, the trough having an upper edge and the holder having peripheral flange extending outwardly from the upper edge of the trough and the flange being mounted with a liquid and gas tight seal in an exterior wall of the container;

the straw extending through the aperture in the holder having the stowed position and an in use position and the straw having a snug fit in the aperture;

a sealing means for sealing the straw in the stowed position with a liquid and gas tight seal thereby sealing the liquid inside the container.

2. A liquid container as claimed in claim 1 wherein the straw is resiliently deformable.

3. A liquid container as claimed in claim 1 wherein the container body is a parallelepipedic shape.

4. A liquid container as claimed in claim 1 wherein the holder has a sleeve extending orthogonally from the trough with the distal end thereof encircling the aperture.

5. A liquid container as claimed in claim 1 wherein the sealing means is a sealing strip attached to the flange in a liquid and gas tight seal.

6. A liquid container as claimed in claim 5 wherein the sealing strip has a tab portion that extends outwardly from the container.

7. A liquid container as claimed in claim 1 wherein the sealing means is a sealing strip attached to the flange and the container in a liquid and gas tight seal.

8. A liquid container as claimed in claim 1 wherein the sealing means is a sealing strip attached to the container in a liquid and gas tight seal.

9. A liquid container as claimed in claim 5 wherein the sealing strip has written material thereon.

10. A liquid container as claimed in claim 1 wherein the container body is a gable top shaped box.

11. A liquid container as claimed in claim 1 wherein the container body is a gable top shaped box.

12. A liquid container as claimed in claim 1 wherein the container is a parallelepipedic type carton.

13. A liquid container as claimed in claim 1 wherein the container is a gable type carton and the flange is adapted to be attached to the inside thereof.

14. A liquid container as claimed in claim 1 wherein the container is a gable type carton and the flange is adapted to be attached to the outside thereof.

15. A holder for use with an individual beverage container and a straw comprising:

a trough having an aperture formed therein dimensioned to receive the straw snugly therein and a vent hole formed therein;

a flange extending laterally from the trough to be attached to the container;

a sleeve extending orthogonally from the trough with the distal end thereof encircling the aperture; and a straw integrally attached to the holder.

16. A holder as claimed in claim 15 wherein the holder has a thin uniform wall thickness.

17. A holder as claimed in claim 15 further including a straw extending through the aperture in the trough.

18. A holder as claimed in claim 15 further including a straw extending through the aperture in the trough the straw having a stowed position and an in use position, a sealing strip attached to the holder in an liquid and gas tight seal and covering the straw in the stowed position.

19. A liquid container of plastic coated boxboard, or laminated cardboard comprising:

a container body having an interior volume and a plurality of exterior walls;

a resiliently deformable holder having an aperture and a trough formed therein, the trough being contiguous with the aperture, the trough being dimensioned to receive a straw in a stowed position, the trough having an upper edge and the holder having a peripheral flange extending outwardly from the upper edge of the trough and the flange being mounted with a liquid and gas tight seal in an exterior wall of the container;

the resiliently deformable straw extending through the aperture in the holder having the stowed position and an in use position and the straw having a snug fit in the aperture;

a sealing means for sealing the straw in the stowed position with a liquid and gas tight seal thereby sealing the liquid inside the container.

20. A liquid container of plastic coated boxboard, or laminated cardboard comprising:

a container body having an interior volume and a plurality of exterior walls;

a holder having an aperture and a trough formed therein, the trough being contiguous with the aperture, the trough being dimensioned to receive a straw in a stowed position, the trough having an upper edge and the holder having a peripheral flange extending outwardly from the upper edge of the trough and the flange being mounted with a liquid and gas tight seal in an exterior wall of the container;

the straw extending through the aperture in the holder having the stowed position and an in use position and the straw having a snug fit in the aperture;

a resealable cap releasably attached to the holder for sealing the straw in the stowed position with a liquid and gas tight seal thereby sealing the liquid inside the container.

21. A liquid container of plastic coated boxboard, or laminated cardboard comprising:

a container body having an interior volume and a plurality of exterior walls;

a holder having an aperture and a trough formed therein, the trough being contiguous with the aperture, the trough being dimensioned to receive a straw in a stowed position, the trough having an upper edge and the holder having a peripheral flange extending outwardly from the upper edge of the trough and the flange being mounted with a liquid and gas tight seal in an exterior wall of the container;

the straw extending through the aperture in the holder having the stowed position and an in use position and the straw having a snug fit in the aperture;

a a resealable flap attached to the holder with a living hinge for sealing the straw in the stowed position with a liquid and gas tight seal thereby sealing the liquid inside the container.

22. A holder for use with an individual beverage container and a straw comprising:

a trough having an aperture formed therein dimensioned to receive the straw snugly therein;

a flange extending laterally from the trough to be attached to the container;

a sleeve extending orthogonally from the trough with the distal end thereof encircling the aperture; and a resealable flap attached to the holder with a living hinge.

23. A holder for use with an individual beverage container and a straw comprising:

a trough having an aperture formed therein dimensioned to receive the straw snugly therein;

a flange extending laterally from the trough to be attached to the container;

a sleeve extending orthogonally from the trough with the distal end thereof encircling the aperture; and a resealable cap releasably attached to the holder.

* * * * *